US008528780B2

(12) United States Patent
Houghton et al.

(10) Patent No.: US 8,528,780 B2
(45) Date of Patent: Sep. 10, 2013

(54) SMOKING ARTICLE DISPENSER

(75) Inventors: Chris Houghton, London (GB); Ian Mckinnon, London (GB)

(73) Assignee: British American Tobacco (Investments) Limited, London (GB)

( * ) Notice: Subject to any disclaimer, the term of this patent is extended or adjusted under 35 U.S.C. 154(b) by 133 days.

(21) Appl. No.: 13/146,920

(22) PCT Filed: Dec. 23, 2009

(86) PCT No.: PCT/EP2009/067843

§ 371 (c)(1),
(2), (4) Date: Oct. 10, 2011

(87) PCT Pub. No.: WO2010/086075

PCT Pub. Date: Aug. 5, 2010

(65) Prior Publication Data

US 2012/0024882 A1 Feb. 2, 2012

(30) Foreign Application Priority Data

Jan. 29, 2009 (GB) ..... 0901466.3

(51) Int. Cl.
*A24F 15/14* (2006.01)

(52) U.S. Cl.
USPC ..... 221/71; 221/70; 221/88; 221/119; 221/121

(58) Field of Classification Search
USPC ..... 221/25, 69, 70, 71, 73, 76, 87, 88, 221/89, 91, 119, 121, 122, 218, 253
See application file for complete search history.

(56) References Cited

U.S. PATENT DOCUMENTS

| | | | | | |
|---|---|---|---|---|---|
| 1,407,746 | A | * | 2/1922 | Hagarty | 221/218 |
| 1,824,753 | A | * | 9/1931 | Thompson | 206/353 |
| 1,830,571 | A | * | 11/1931 | Sullwald | 206/258 |
| 1,850,410 | A | | 3/1932 | Milam | |
| 2,032,094 | A | * | 2/1936 | Le Voci | 221/77 |
| 2,216,476 | A | | 10/1940 | Markowitsch | |

(Continued)

FOREIGN PATENT DOCUMENTS

| | | |
|---|---|---|
| BE | 1006579 | 10/1994 |
| CN | 2210545 Y | 10/1995 |

(Continued)

OTHER PUBLICATIONS

International Search Report and Written Opinion, mailed Apr. 7, 2010 for PCT International Application No. PCT/EP2009/067843, filed Dec. 23, 2009.

(Continued)

*Primary Examiner* — Timothy Waggoner
(74) *Attorney, Agent, or Firm* — NW Poulsen

(57) ABSTRACT

A dispenser comprises a housing defining a chamber to receive a charge of smoking articles coupled by a belt and such that the longitudinal axis of each smoking article extends between first and second ends of die housing. The dispenser includes a mechanism to advance the belt in a lateral direction so as to move a smoking article of the belt into alignment with an aperture in said first end of the housing. The mechanism is also operable to push said aligned smoking article from the belt and eject it in a longitudinal direction from the housing through said aperture. A belt for use in such a dispense!, and a method of filling such a dispenser.

33 Claims, 29 Drawing Sheets

(56) References Cited

U.S. PATENT DOCUMENTS

| | | | | | |
|---|---|---|---|---|---|
| 2,275,965 | A | | 3/1942 | Charles | |
| 2,327,120 | A | | 8/1943 | McCoon | |
| 2,491,617 | A | | 12/1949 | Lebach | |
| 2,512,207 | A | | 6/1950 | Isaac | |
| 2,513,672 | A | | 7/1950 | Pino | |
| 2,519,020 | A | | 8/1950 | Breitwieser | |
| 2,535,761 | A | | 12/1950 | Szymanski | |
| 2,565,183 | A | | 8/1951 | Morgan | |
| 2,818,970 | A | * | 1/1958 | Pough | 221/76 |
| 2,971,676 | A | | 2/1961 | Honcharenko | |
| 3,101,157 | A | | 8/1963 | Russell | |
| 3,165,249 | A | | 1/1965 | Peck | |
| 3,667,650 | A | | 6/1972 | Noda et al. | |
| 3,815,734 | A | | 6/1974 | Krukel | |
| 4,120,423 | A | | 10/1978 | Fruehwirth | |
| 4,275,819 | A | | 6/1981 | Perez | |
| 4,342,902 | A | | 8/1982 | Ping | |
| 4,507,704 | A | | 3/1985 | Chuang | |
| 4,844,244 | A | | 7/1989 | Mawby | |
| 5,005,698 | A | * | 4/1991 | Mikhail | 206/257 |
| 5,265,717 | A | * | 11/1993 | Daghestani | 206/88 |
| 5,353,956 | A | | 10/1994 | Wilson | |
| 5,566,855 | A | * | 10/1996 | Bradach | 221/77 |
| 6,220,428 | B1 | | 4/2001 | Lan | |
| 6,695,136 | B1 | | 2/2004 | Torres | |
| 7,207,463 | B1 | | 4/2007 | Balko | |
| 2006/0243611 | A1 | | 11/2006 | Wu | |
| 2007/0246382 | A1 | | 10/2007 | He | |
| 2008/0185303 | A1 | | 8/2008 | He | |

FOREIGN PATENT DOCUMENTS

| | | | |
|---|---|---|---|
| DE | 8703385 | U1 | 8/1987 |
| EP | 836810 | | 4/1998 |
| EP | 1497203 | | 6/2006 |
| EP | 1797781 | | 6/2007 |
| FR | 969917 | A | 12/1950 |
| GB | 182607 | | 7/1922 |
| GB | 217536 | | 6/1924 |
| GB | 226446 | | 12/1924 |
| GB | 283339 | | 1/1928 |
| GB | 325750 | | 2/1930 |
| GB | 371982 | | 5/1932 |
| GB | 442798 | | 2/1936 |
| GB | 486507 | | 6/1938 |
| GB | 499271 | | 1/1939 |
| GB | 509679 | | 7/1939 |
| GB | 800134 | | 8/1958 |
| GB | 807323 | | 1/1959 |
| GB | 1045238 | | 10/1966 |
| GB | 1080182 | | 8/1967 |
| UA | 52 185 | A | 12/2002 |
| UA | 28 148 | U | 11/2007 |
| WO | 0154521 | | 8/2001 |
| WO | 03/012288 | | 2/2003 |
| WO | WO2008/098816 | A1 | 8/2008 |

OTHER PUBLICATIONS

International Preliminary Report on Patentability, mailed May 4, 2011 for PCT International Application No. PCT/EP2009/067843, filed Dec. 23, 2009.

"Automatic Eject Metalic [sic] Cigarette Case." http://www.youtube.com/watch?v=svjcypr9Oa0&feature=related#.

"China Automatic Cigarette Case. Shenzhen Manufacturer." http://metal-gifts.manufacturer.globalsources.com/si/6008818151493/pdtl/Cigarette-case/1004832805/Automatic-Cigarette-Case.htm.

"Automatic Eject Cigarette Case with Lighter." http://www.youtube.com/watch?v=ZZUX7YDz-IU.

"DealExtreme: $6.33 Automatic Ejection Butane Lighter Cigarette Case." http://www.dealextreme.com/details.dx/sku.4217.

"Auto Dispensing Cigarette Case." http://www.goneblue.com/audicica.html.

"Light Weight Single Action Dispensing Cigarette Case." http://www.goneblue.com/liwesiacdici.html.

"Discount Paper Cigarette Cases Wholesale, Buy China Custom Paper Cigarette Cases Wholesalers." http://www.toppromotional.com/gifts-shop/ProductShow.asp?ArticleID=2103.

Examination Report issued by the Canadian Intellectual Property Office for Application No. 2,749,491, mailed Feb. 11, 2013.

Translation of Office Action issued Nov. 1, 2012 for Ukrainian Patent Application No. 2011 10278.

* cited by examiner

SMOKING ARTICLE DISPENSER

CLAIM FOR PRIORITY

This application is a National Stage Entry entitled to and hereby claims priority under 35 U.S.C. §§365 and 371 to corresponding PCT Application No. PCT/EP2009/067843, filed Dec. 23, 2009, which in turn claims priority to British Application Serial No. GB 0901466.3, filed Jan. 29, 2009. The entire contents of the aforementioned applications are herein expressly incorporated by reference.

The present invention relates to a dispenser for smoking articles such as cigarettes and, more particularly, to a dispenser for smoking articles having a smoking article indexing and ejection mechanism.

Various dispensers of smoking articles are known in the art which comprise a portable housing and means to dispense a single smoking article at a time from the dispenser. However, such known dispensers suffer a number of drawbacks, including awkward, unreliable, cumbersome and/or complex dispensing mechanisms. Furthermore, conventional dispensers are generally configured such that a user has to manually load individual cigarettes one at a time. The present invention seeks to provide an improved dispenser for smoking articles which overcomes the drawbacks of the prior art.

In order to address the issues related to the prior art dispensers, a dispenser has been developed that includes a reloadable springless cartridge based solution.

Accordingly, in an implementation, the present invention provides a dispenser comprising a housing defining a chamber to receive a charge of smoking articles coupled by a belt and such that the longitudinal axis of each smoking article extends between first and second ends of the housing, and a mechanism to advance the belt in a lateral direction so as to move a smoking article of the belt into alignment with an aperture in said first end of the housing, said mechanism also being operable to push said aligned smoking article from the belt and eject it in a longitudinal direction from the housing through said aperture.

Preferably, the mechanism includes a slider received in the chamber configured to contact the end of an aligned smoking article closest to the second end of the housing to lift said smoking article in a longitudinal direction out of the housing through the aperture.

The slider preferably includes an actuator that extends through the housing to enable a user to raise the slider in a direction towards said first end of the housing and thereby lift said smoking article in a longitudinal direction out of the housing through the aperture in the first end.

Preferably, the mechanism includes a belt drive wheel rotatably mounted to the second end of the housing and extending upwardly within the chamber towards said first end.

The drive element preferably comprises a plurality of longitudinally extending pockets, each pocket being configured so that a smoking article is drawn into a pocket as the drive wheel rotates to advance the belt.

Preferably, the belt drive wheel is positioned such that when it rotates, a smoking article contained in a pocket is moved into alignment with the aperture.

The slider and belt drive wheel preferably include cooperating members that cooperate to rotate the drive wheel to advance the belt and move a smoking article into partial alignment with the aperture in the first end of the housing in response to movement of the slider by a user.

In a preferred embodiment, a smoking article contained in a pocket of the belt drive wheel is moved into partial alignment with the aperture in the first end of the housing in response to lowering of the slider in a direction towards the second end of the housing following movement of the slider in a direction towards the first end of the housing to eject a previous smoking article.

Preferably, the belt drive wheel and the housing is configured such that the belt drive wheel has a portion that extends below a charge of smoking articles received in the chamber at the second end of the housing, the cooperating member on the belt drive wheel being formed on said portion of the belt drive wheel below a charge of smoking articles received in the chamber.

The cooperating member on the belt drive wheel preferably comprises an upwardly facing helical ramp associated with each pocket.

Preferably, the cooperating member on the slider comprises a drive element having a lower engaging face that contacts an upper end of the helical ramp associated with the pocket from which a smoking article has been ejected, when the slider is lowered following movement of the slider in an upward direction to eject said smoking article, wherein the belt drive wheel rotates as the drive element slides down the helical ramp to advance the belt and move the next smoking article into partial alignment with the aperture in the first end of the housing.

The belt drive wheel preferably comprises a smoking article end support member associated with each pocket and configured to support the end of a smoking article received in a pocket to prevent it from sliding down the belt drive wheel in a direction towards said helical ramp.

Preferably, a smoking article end support member is located above the lower end of each helical tamp and each helical ramp is configured such that, when the drive element has reached the lower end of the helical ramp associated with one pocket, it is located beneath said smoking article end support member associated with the next pocket.

Preferably, the smoking article end support member has a lower contact surface and the drive element has an upper engaging face, at least one of said lower contact surface and upper engaging face being angled such that, when the slider is raised to eject a smoking article from a pocket, the upper engaging face of the drive element initially contacts said lower contact surface of the support member located above it, thereby causing the belt drive wheel to rotate as the lower contact surface and upper engaging face slide relative to each other so as to move a partially aligned smoking article into full alignment with the aperture.

Preferably, the upper engaging face of the drive element contacts the end of a fully aligned smoking article supported by said smoking article end support member after clearing said lower contact surface of the support member, further movement of the slider causing said drive element to lift said fully aligned smoking article in a longitudinal direction out of the housing through the aperture.

Preferably, the cooperating member on the belt drive wheel comprises a radially extending spoke associated with each pocket, each spoke having upper and lower contact faces.

Preferably, the cooperating member on the slider comprises an initial drive element having a lower contact surface to contact the upper contact face of a spoke associated with a pocket as the slider is lowered following ejection of a smoking article from said pocket, at least one of said lower contact surface and upper contact face being angled such that the drive wheel rotates as the spoke slides across the initial drive element to move a leading smoking article into partial alignment with the aperture.

Preferably, the cooperating member on the slider also comprises a secondary drive element defining an upwardly facing helical ramp positioned below the initial drive element and configured such that, when the slider is lowered, the secondary drive element passes between adjacent spokes extending from the drive wheel prior to cooperation between the initial drive element and a spoke to cause initial rotation of the drive wheel.

Preferably, the initial drive element and spokes are configured such that following initial rotation of the drive wheel as a result of cooperation between the drive element and a spoke, a spoke associated with the next pocket is located above the helical ramp of the secondary drive element such that, when the slider is raised to eject a smoking article associated with said next pocket, the helical ramp contacts the lower contact face of said spoke such that the drive wheel rotates further as the spoke slides across said ramped helical surface of the secondary drive element to move a smoking article fully into alignment with said aperture, said secondary drive element passing between adjacent spokes following said rotation and after a spoke has cleared said ramped helical surface.

Preferably, the initial drive element has an upper surface to contact the second end of a smoking article and lift it out of a pocket through said aperture when the slider is raised.

Preferably, the first end of the housing comprises a cap to close the chamber and enable access to the chamber to allow a charge of smoking articles to be inserted therein, said aperture being formed in the cap.

Another implementation of the invention provides a belt to receive a charge of smoking articles comprising a material layer having a series of parallel sleeves, each sleeve extending in a direction across the width of the belt, each sleeve being configured to receive a single smoking article.

Preferably, the material layer comprises first and second material layers, said layers being permanently connected to each other at spaced locations along the length of the belt to define said series of sleeves.

Preferably, the material layers are in the form of an endless loop.

Preferably, the belt is folded following insertion of a charge of smoking articles to form a bundle or cartridge of smoking articles. Preferably, adjacent material layers of the bundle are releasably joined at discrete locations to retain the smoking articles in bundled form.

Preferably, the bundle is formed with an aperture therethrough to receive a drive element of a smoking article dispenser.

An implementation of the invention also provides a dispenser as described above configured to receive a belt containing a charge of smoking articles as described above and also, a dispenser according as described above containing a belt of smoking articles as described above.

An implementation of the present invention also provides a method of filling a dispenser as described above with a belt of smoking articles as described above, comprising the steps of opening the housing and inserting a bundle of cigarettes into the chamber.

Preferably, the method includes the step of inserting the bundle such that the drive wheel of the dispenser extends through the aperture in said bundle and closing said housing.

The method preferably includes the step of actuating the actuator to initially break the releasable join between adjacent material layers of the bundle.

An implementation of the present invention also provides a method of using a dispenser as described above, including the steps of sliding the actuator in a direction towards the top end of the housing to initially rotate a drive wheel to move a leading smoking article into alignment with an aperture in said top end and to push said leading smoking article out of said housing through said aperture.

The method preferably includes the step of sliding the actuator in a direction towards the lower end of the housing to further rotate the drive wheel in the same direction and move the next leading smoking article into partial alignment with the aperture in the housing.

An implementation of the present invention also provides a smoking article dispenser comprising a dispenser housing configured to receive a smoking article cartridge, a smoking article dispensing aperture formed in the surface of the dispenser housing, a cartridge advancement mechanism that includes a plurality of surface-engagable elements configured to facilitate advancing cartridge position and dispensing smoking articles from a smoking article cartridge when a user-operable element is actuated.

Preferably, the plurality of surface-engagable elements are configured to urge a drive wheel that advances smoking articles from the smoking article cartridge within the dispenser housing into alignment for dispensing.

Preferably, the smoking articles are seated on a support tab that ejects the smoking articles after the smoking articles are fully aligned.

Preferably, the smoking article cartridge is configured as a belt of smoking articles.

Preferably, the user-operable element is slidable between a first position and a second position.

Preferably, the user-operable element interacts with the surface engagable elements to shift a smoking article from a standby position, wherein the smoking article is partially aligned with a dispensing aperture in the first position, to a dispensing position, wherein the smoking article is fully aligned with the dispensing aperture.

The dispensers facilitate significant design flexibility and a variety of housings, engagable surface elements and smoking article cartridges may be implemented. By way of example only, to illustrate various aspects of the dispenser, the figures and the following discuss the smoking article cartridge within the context of a cartridge implemented as a smoking article belt.

Depending on the implementation, the dispenser aperture and the dispensed smoking articles may be configured with complementary aperture/axial shapes. For example, the dispenser aperture may be configured as an oval, square, triangle or other shape particularly suited to dispense complementary shaped smoking articles.

The method may include the step of actuating the actuator to initially break the releasable join between adjacent material layers of the bundle.

Preferred embodiments of the present invention will now be described, by way of example only, with reference to the accompanying drawings, in which.

For the purposes of the exemplary embodiments shown and described herein, reference to smoking articles to be dispensed from the apparatuses of the invention are described as 'cigarettes', but it should be understood that this term shall be taken as meaning any smoking article, not necessarily limited to cigarettes.

Figure 3:
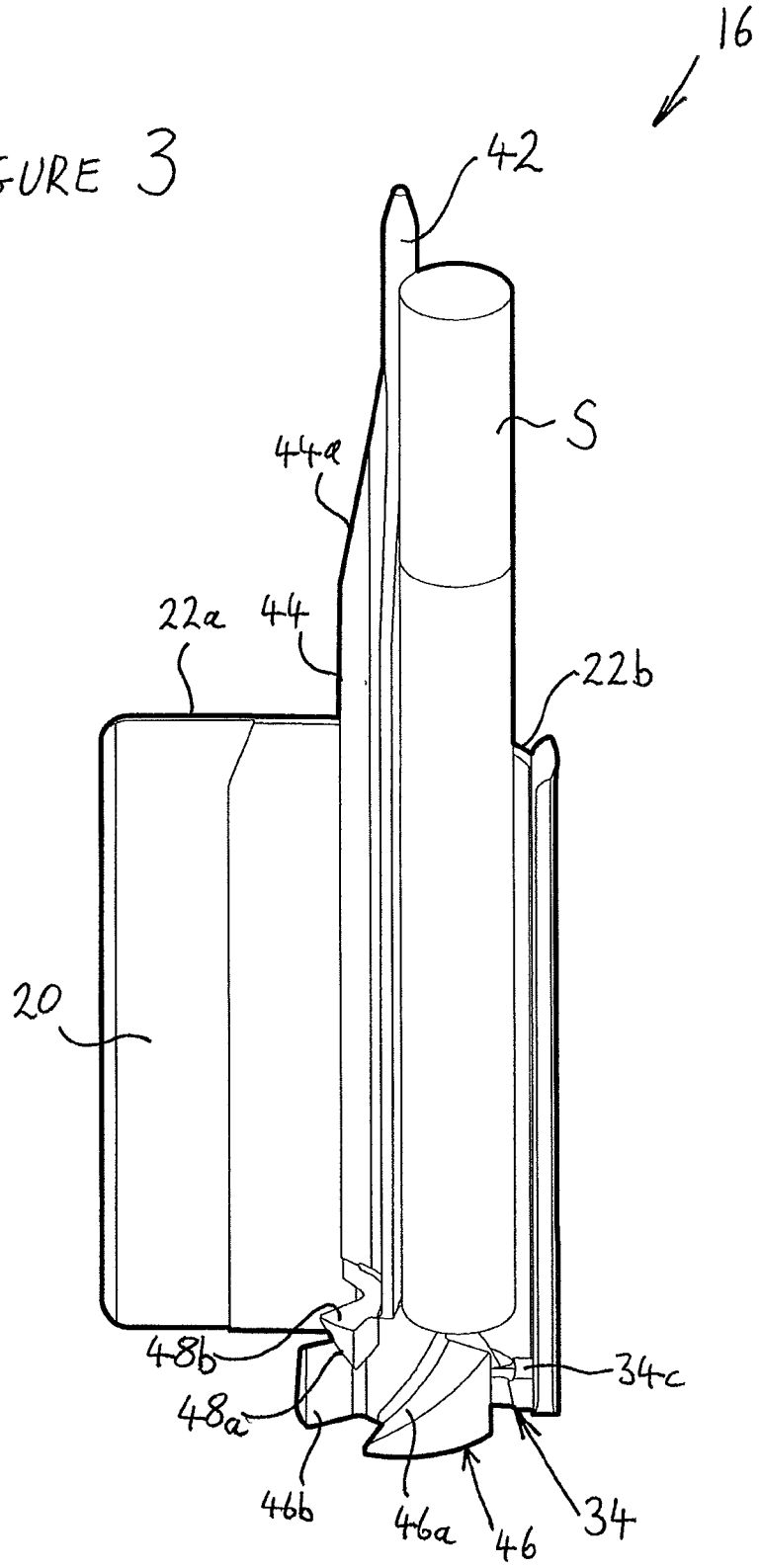
FIG. 3 is a rear perspective view of internal components of the dispenser of FIGS. 1 and 2 showing only the slider and drive wheel, in a standby position.

Referring now to FIGS. 1 to 15, a first embodiment of a cigarette dispenser 10 of the present invention is shown comprising an outer housing 12 having a cap 14 and a dispensing mechanism 16 (see FIG. 3) disposed within the housing 12. The cap 14 includes a dispensing aperture 14*a* though which cigarettes 'S' are dispensed from the dispenser 10. The dispenser 10 is configured to receive a charge of cigarettes S (see FIGS. 28 and 29) held in a belt 18 and sequentially index and dispense each cigarette S from the dispenser 10 through the dispensing aperture 14*a* until all of the cigarettes S have been dispensed, after which, the cap 14 is removed, the empty belt 18 is removed and the dispenser can be reloaded by a user with a new full belt 18 of cigarettes S.

The housing 12 is generally cuboid in shape but has rounded narrow ends instead of squared. Thus, the housing 12 has two substantially flat side walls 12*a*, and two rounded end walls 12*b*, in which the rounded end walls 12*b* in plan view define an arc with a centre point 'P' (see FIG. 1).

The dispensing mechanism 16 is shown in more detail in FIGS. 2 to 15, and comprises a slider 20 and a belt drive wheel or carousel 40 (referred to hereafter as a 'drive wheel'). The slider 20 (see FIG. 14) comprises a sliding plate 22 having an actuator button 24 (referred to hereafter as an 'actuator') projecting therefrom. The sliding plate 22 is shaped to conform to the inside surface of the housing 12 and slides thereagainst, with the actuator 24 extending though a slot 26 formed in one of the flat side walls 12*a* of the housing 12. The length of the slot 26 thereby defines the maximum range of sliding movement of the slider 20 within the housing 12. The sliding plate 22 includes a first flat section 22*a* shaped to extend along and lie adjacent to the inside of one flat side wall 12*a* of the housing 12, and a second curved section 22*b* shaped to curve around the inside of one curved end wall 12*b* of the housing 12. Therefore, the curved section 22*b* of the sliding plate 22 defines an arc with a centre point substantially vertically aligned with the centre point 'P' of the curved end wall 12*b* of the housing 12.

Figure 14:
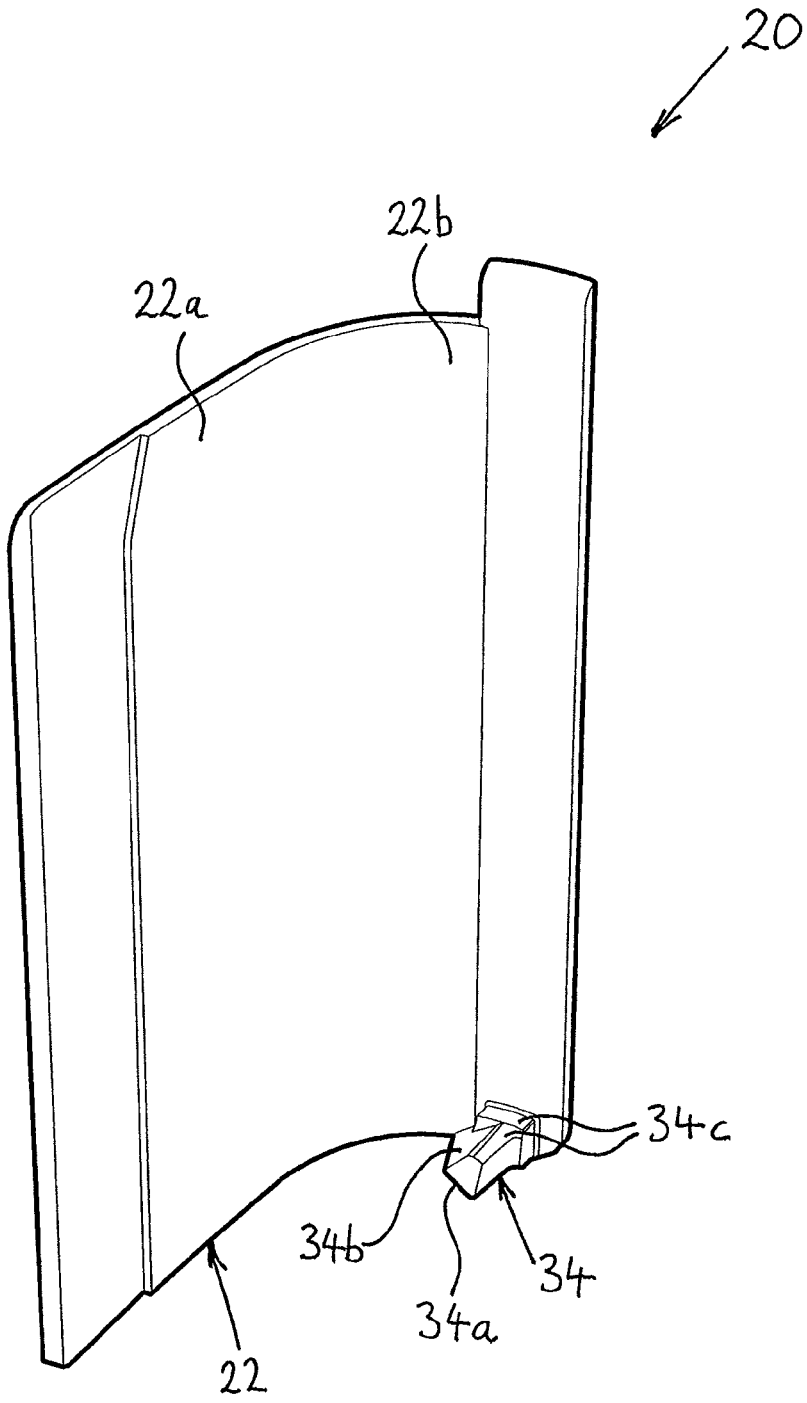
FIG. 14 is a perspective view of the slider in isolation.
Figure 15:
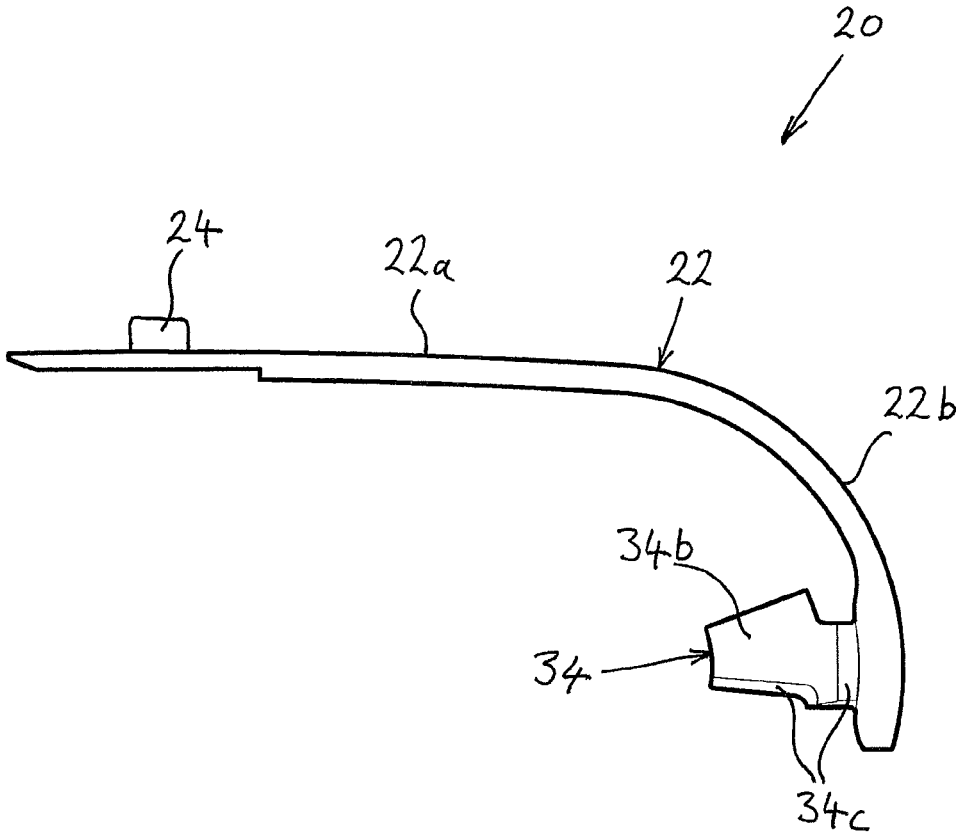
FIG. 15 is a plan view from above of the slider of FIG. 14.

The curved section 22*b* of the sliding plate 22 includes a drive element 34 extending perpendicularly inwards, and is shown in more detail in FIGS. 14 and 15. The drive element 34 includes a lower engaging face 34*a*, an upper engaging face 34*b* and a lifting face 34*c*.

The drive wheel 40 is rotatably mounted on a base 60. The base 60 has an upper surface which provides a platform 62 to support the cigarettes S in the belt 18 within the housing 12. The base 60 may be removable from or formed integrally with the housing 12, and the drive wheel 40 is mounted such that its axis of rotation is substantially aligned with the centre point 'P' of the radius of curvature of the curved end wall 12*b* of the housing 12, and of the curved section 22*b* of the sliding plate 22. The drive wheel 40 comprises a central shaft 42 having a plurality of fins 44 extending radially therefrom. The embodiment shown in FIGS. 1 to 15 has three fins, although the invention is not limited to this particular configuration. The tops of the fins 44 include a tapered portion 44*a* for reasons which are explained in more detail below. Viewed from above, it can be seen that each of the spaces between the fins 44 provides a pocket to accommodate a single cigarette S within the belt 18 of cigarettes S. The cap 14 includes a recess 14*b* (see FIG. 2) which is configured to receive and locate the uppermost tip of the shaft 42 when the cap 14 is fitted to the housing 12, which rotatably secures the drive wheel 40 in place within the dispenser 10.

The fins 44 extend along the majority of the height of the shaft 42, but terminate proximate the base of the shaft 42, approximately level with the platform 62. Below the fins 44 and the level of the bottom ends of the cigarettes S, the base portion of the shaft 42 includes a set of helical ramps 46 extending radially from the lower-most portion of the shaft 42, and a set of smoking article end support members (referred to hereafter as 'support members') 48 extending radially from the shaft and spaced axially above the helical ramps 46. One helical ramp 46 and one support member 48 is associated with each fin 44/pocket of the drive wheel 40.

Each of the helical ramps 46 extends around a portion of the circumference of the shaft 42 and includes a contact surface 46*a* on its upper side which is angled upwards in an anti-clockwise direction around the shaft 42. Each of the support members 48 extends around a portion of the circumference of the shaft 42 and includes a contact surface 48*a* on its lower side which is angled downwards in an anti-clockwise direction around the shaft 42 and a support surface 48*b* on its upper side which is substantially horizontal. Furthermore, it can be seen from the plan view of the drive wheel 40 in FIG. 13 that each of the support members 48 is positioned circumferentially between the helical ramps 46, that is, circumferentially between the top radial edge of the contact surface 46*a* of one helical ramp 46 and the bottom radial edge of the contact surface 46*a* of the adjacent helical ramp 46.

The platform 62 of the base 60 includes an arcuate recess 64 (see FIG. 2) to accommodate the helical ramps 46 and support members 48 of the drive wheel 40. The platform 62 is level with the supporting surfaces 48*b* of each of the support members 48. Operation of the cigarette dispenser 10 of the first embodiment of the invention will now be described, with reference to FIGS. 1 to 15. Firstly, a user removes the cap 14 from the dispenser 10 and inserts a full belt 18 of cigarettes S into the housing 12. As the belt 18 of cigarettes S is loaded into the housing 12, the tops of the tapered portions 44*a* of the fins 44 help to guide each of the individual cigarettes S from the belt 18 into one of the pockets between the fins 44 as the belt advances. Once the belt 18 of cigarettes S is loaded into the housing 12, the cap 14 is replaced and the dispenser is ready for use.

The apparatus 10 is shown in the standby position in FIGS. 1 to 5 with the first cigarette to be dispensed in partial alignment with the dispensing aperture 14*a* in the cap 14. Here, the slider 20 is at the bottom of its travel with the actuator 24 at the bottom of the slot 26 in the flat side wall 12*a* of the housing 12 and the drive element 34 is disposed directly beneath one of the support members 48 and between the bottom of the contact surface 46*a* of one of the helical ramps 46 and the vertical end face 46*b* of the adjacent one of the helical ramps 46.

Figure 1:
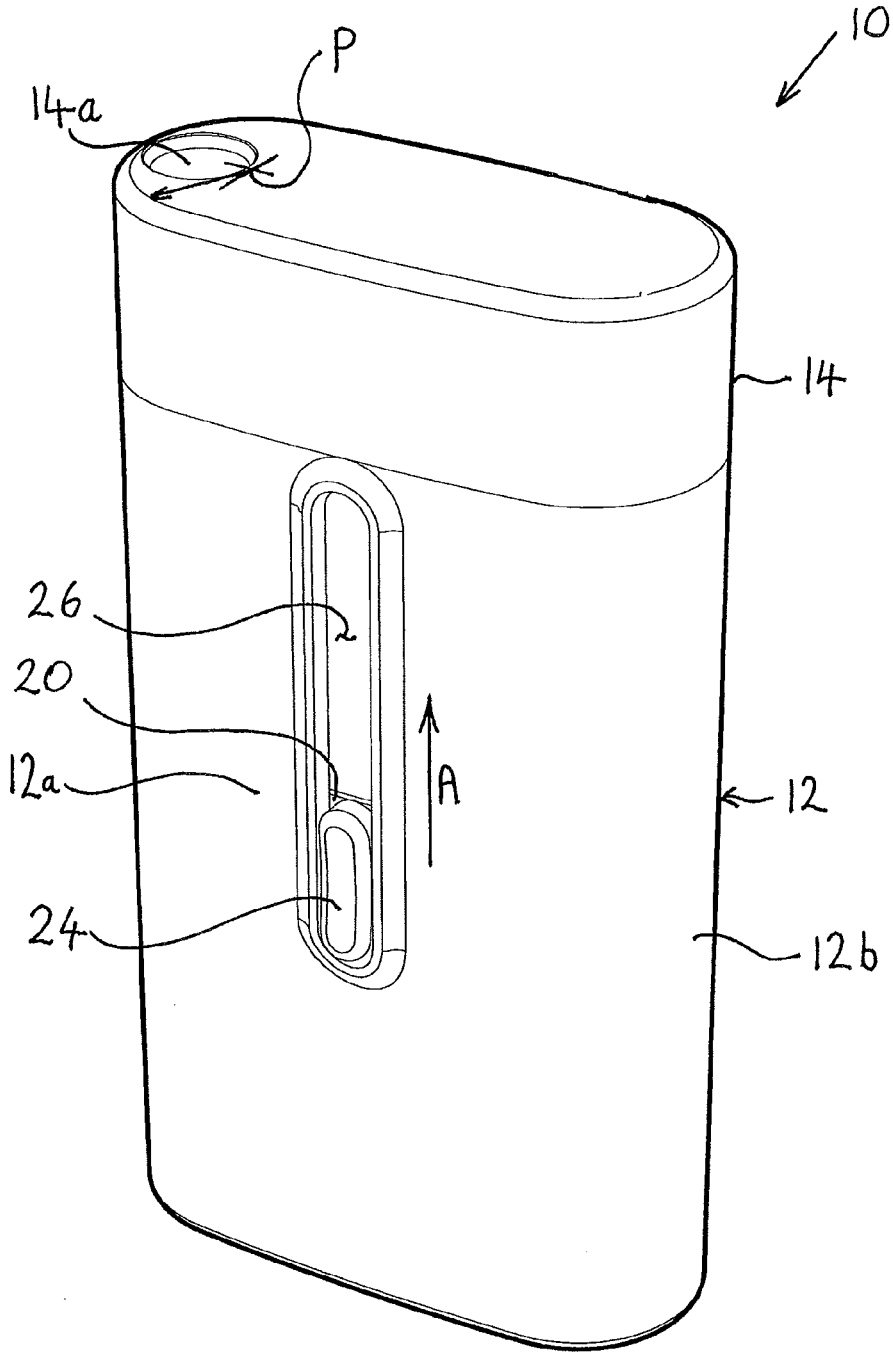
FIG. 1 shows a front perspective view of a dispenser of a first embodiment of the invention.
Figure 2:
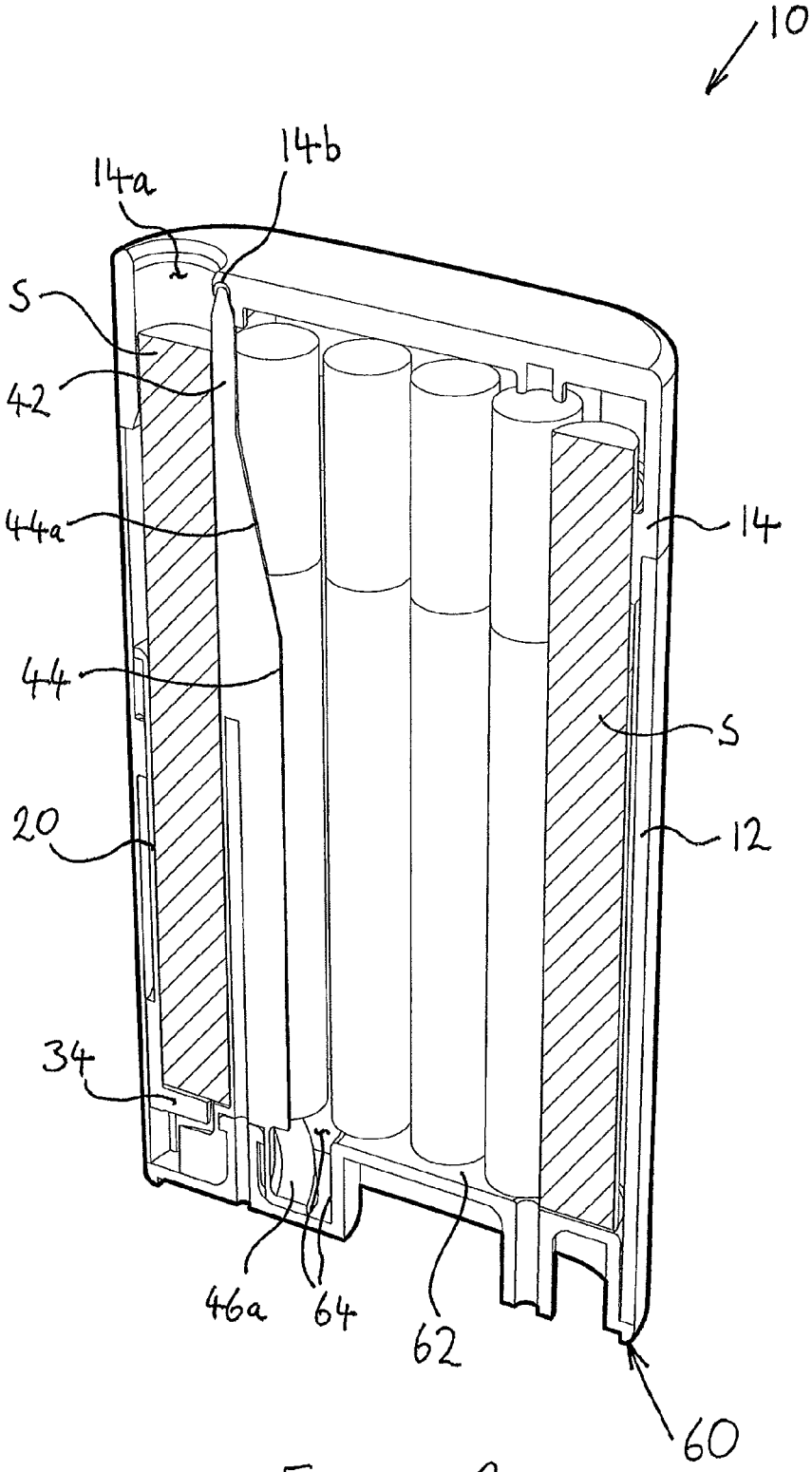
FIG. 2 shows front perspective cross-sectional view of the dispenser of FIG. 1 loaded with a charge of cigarettes.

To dispense a cigarette S from the dispenser 10, the actuator 24 is slid upwards in the direction of arrow 'A' in FIG. 1. This causes the sliding plate 22 and associated drive element 34 to move upwards until the upper engaging face 34*b* of the drive element 34 abuts the lower contact surface 48*a* of the support member 48 as seen in FIG. 5.

Figure 4:
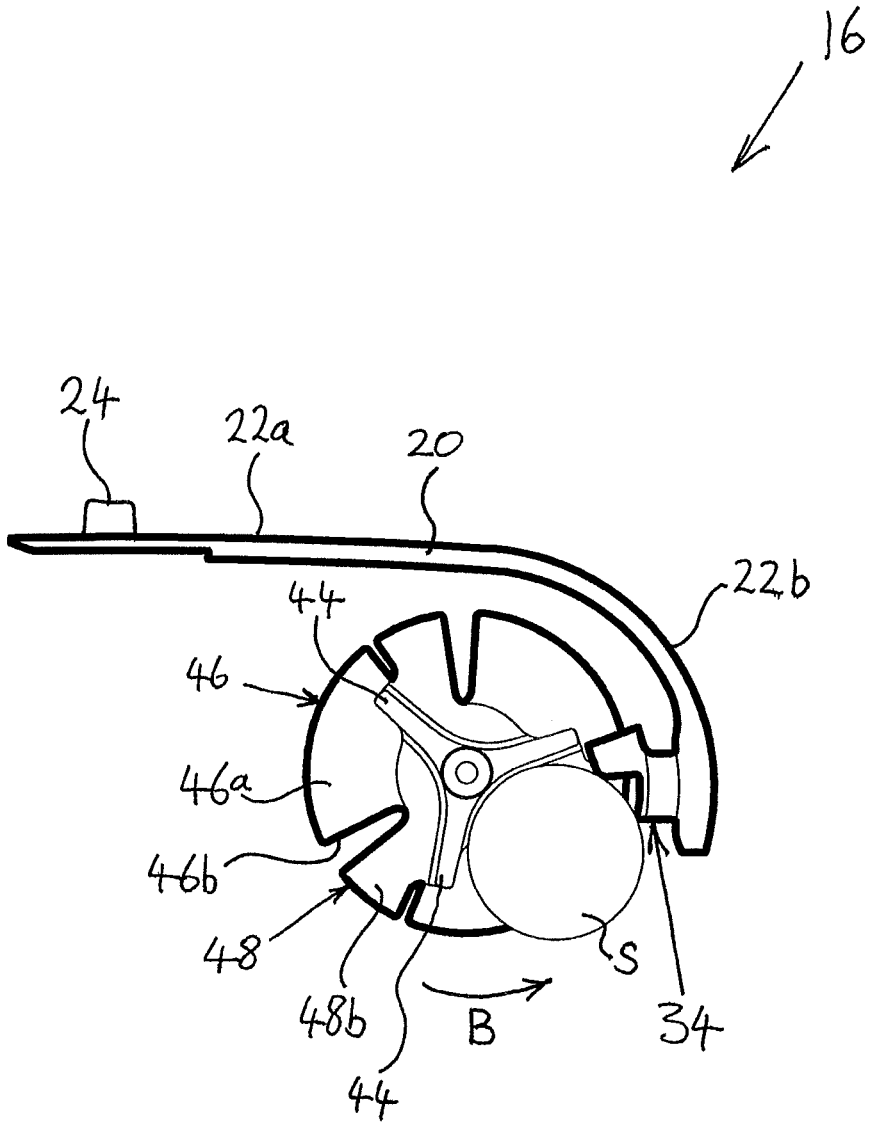
FIG. 4 is a plan view from above of the slider and drive wheel of FIG. 3.
Figure 5:
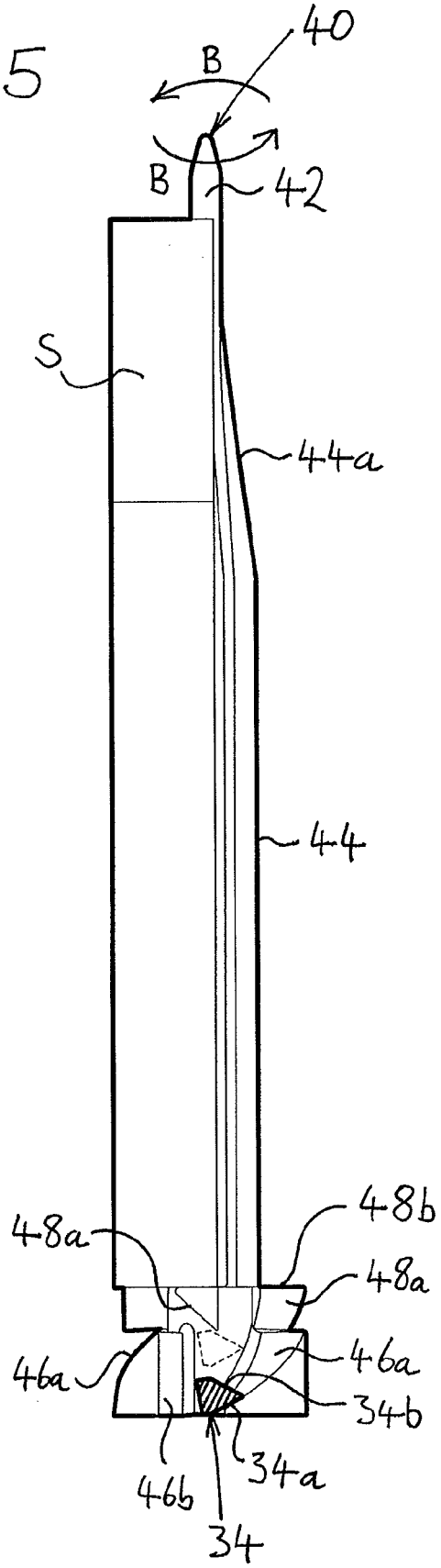
FIG. 5 is an end view of the slider (in cross section) and drive wheel shown in FIGS. 3 and 4.
Figure 6:
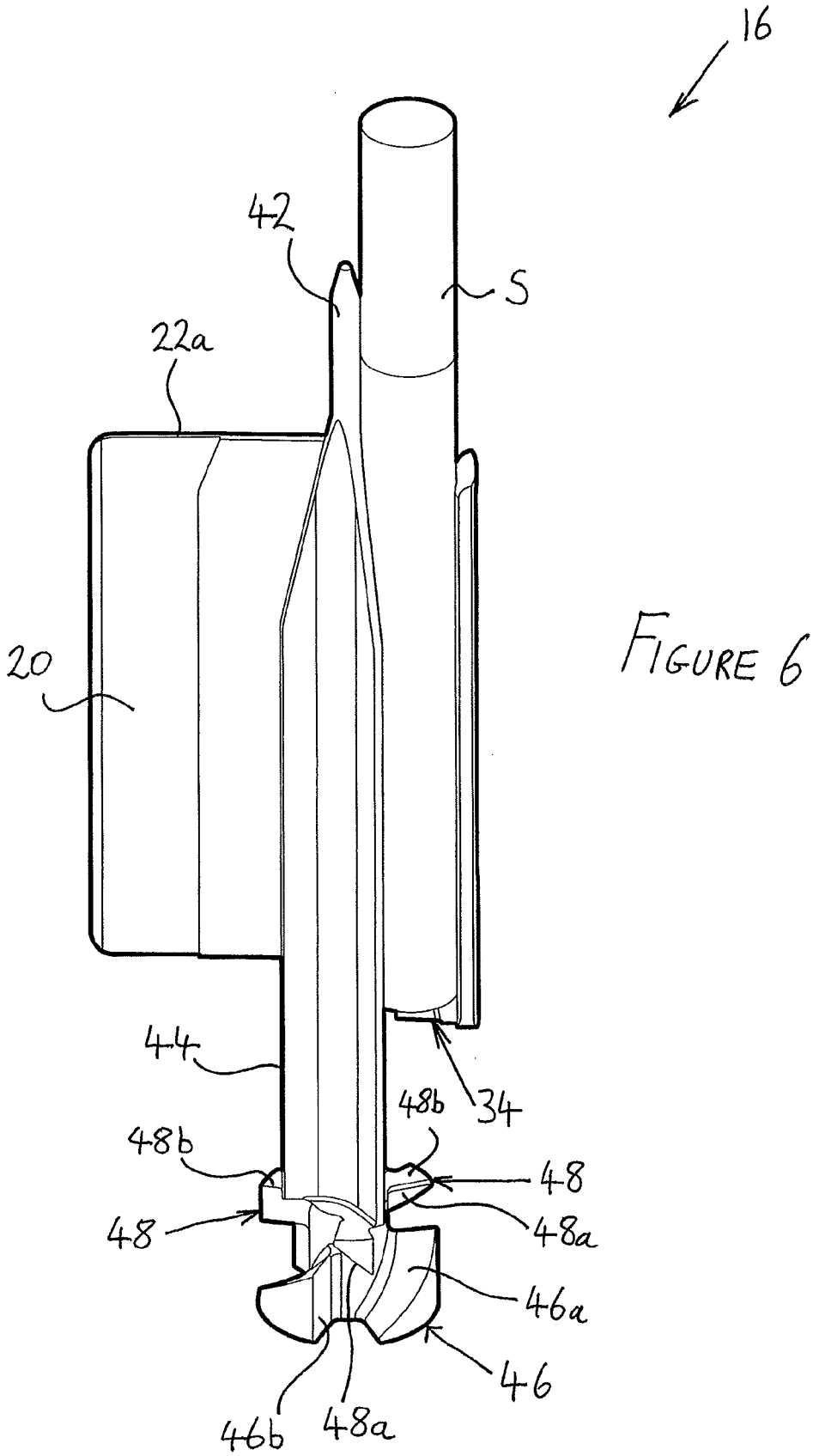
FIG. 6 is a rear perspective view corresponding to FIG. 3 but of the slider and drive wheel of the dispenser in an elevated dispensing position.
Figure 7:
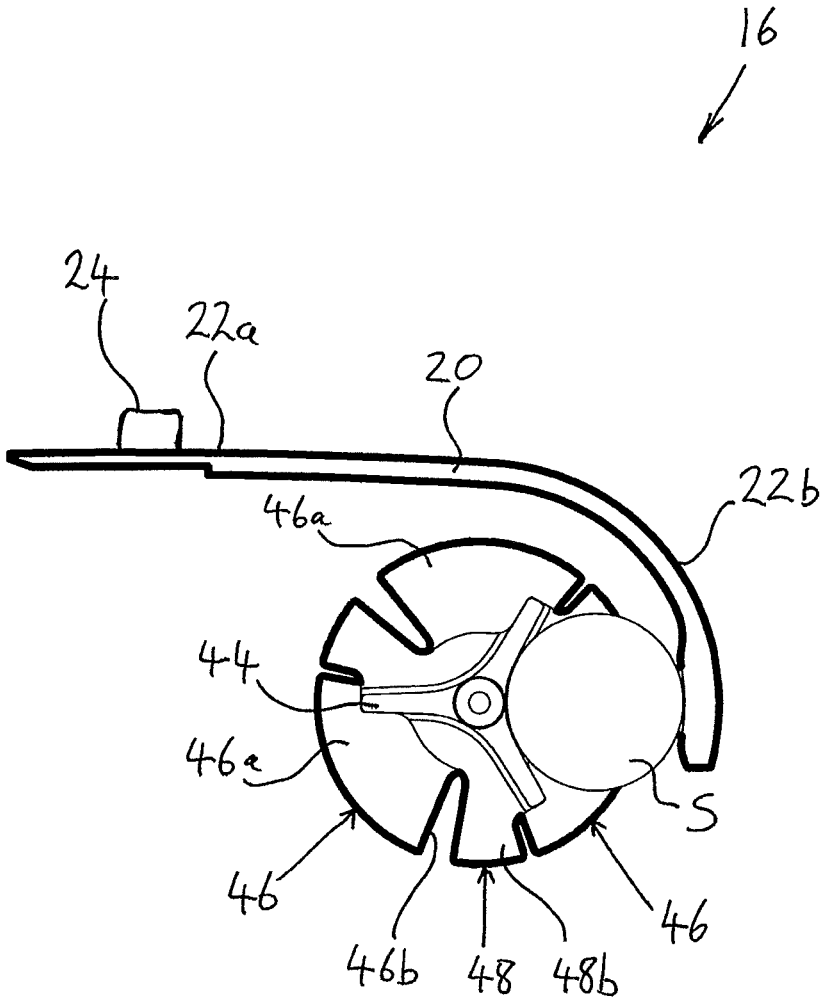
FIG. 7 is a plan view from above of the slider and drive wheel of FIG. 6.
Figure 8:
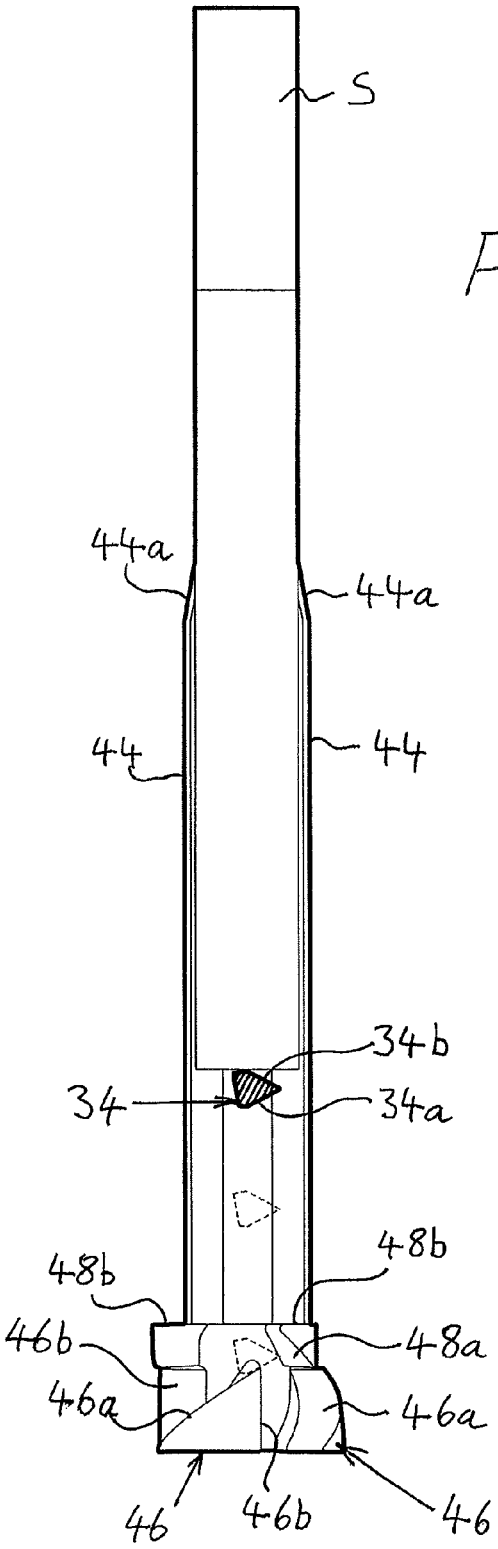
FIG. 8 is an end view of the slider (in cross section) and drive wheel shown in FIGS. 6 and 7.

As the sliding plate 22 and associated drive element 34 continue to move upwards to and past the position shown in dashed lines in FIG. 5, the force of the upper engaging face 34*b* of the drive element 34 against the lower contact surface 48*a* of the support element 48 urges the support element 48 in a cam-like manner (translating the linear movement of the slider 20 into rotational movement of the drive wheel 40) to be rotated anti-clockwise in the direction of arrows shown in FIGS. 4 and 5. Movement of the support element 48 thereby causes the whole drive wheel 40 to be rotated. This portion of rotation comprises a minor movement of the drive wheel 40. The rotation of the drive wheel 40 causes the fins 44 to push against the adjacent cigarette S in the belt 18 of cigarettes S, and so the entire belt 18 of cigarettes S is indexed along. When the lifting surface 34*c* of the drive element 34 becomes level with the support surface 48*b* of the support member 48, the cigarette S being urged by the fin 44 to be dispensed is seated on the lifting surface 34*c* of the drive element 34 and the cigarette to be dispensed is fully aligned with the dispensing aperture 14*a* in the cap 14.

As the sliding plate 22 and associated drive element 34 continue to move upwards, the fully aligned cigarette S is lifted upwards on the lifting surface 34*c* of the drive element 34. The cigarette S protrudes through the dispensing aperture 14*a* in the cap 14 to enable the user to grip the cigarette S and remove it fully from the dispenser 10. At this point, the slider 20 is at the top of its range of movement with the actuator 24 abutting the top edge of the slot 26 in the elevated dispensing position shown in FIGS. 6 to 8. The cigarettes S are held in loose frictional contact within the belt 18 of cigarettes S and so are easily slid upwards out of the belt 18 during the above-described dispensing process, and the belt 18 also serves to guide each cigarette S directly upwards without lateral movement so that it cleanly projects through the dispensing aperture 14*a* in the cap 14.

Depending on the implementation, dispensing aperture 14*a* may be closed off by a actuatable cover element that keeps the cigarettes in the reloadable dispenser fresh. In an implementation, the cover is actuated into an open position as the slider is shifted upward as cigarette S is dispensed and then closed as the slider returns to a standby position.

Figure 9:
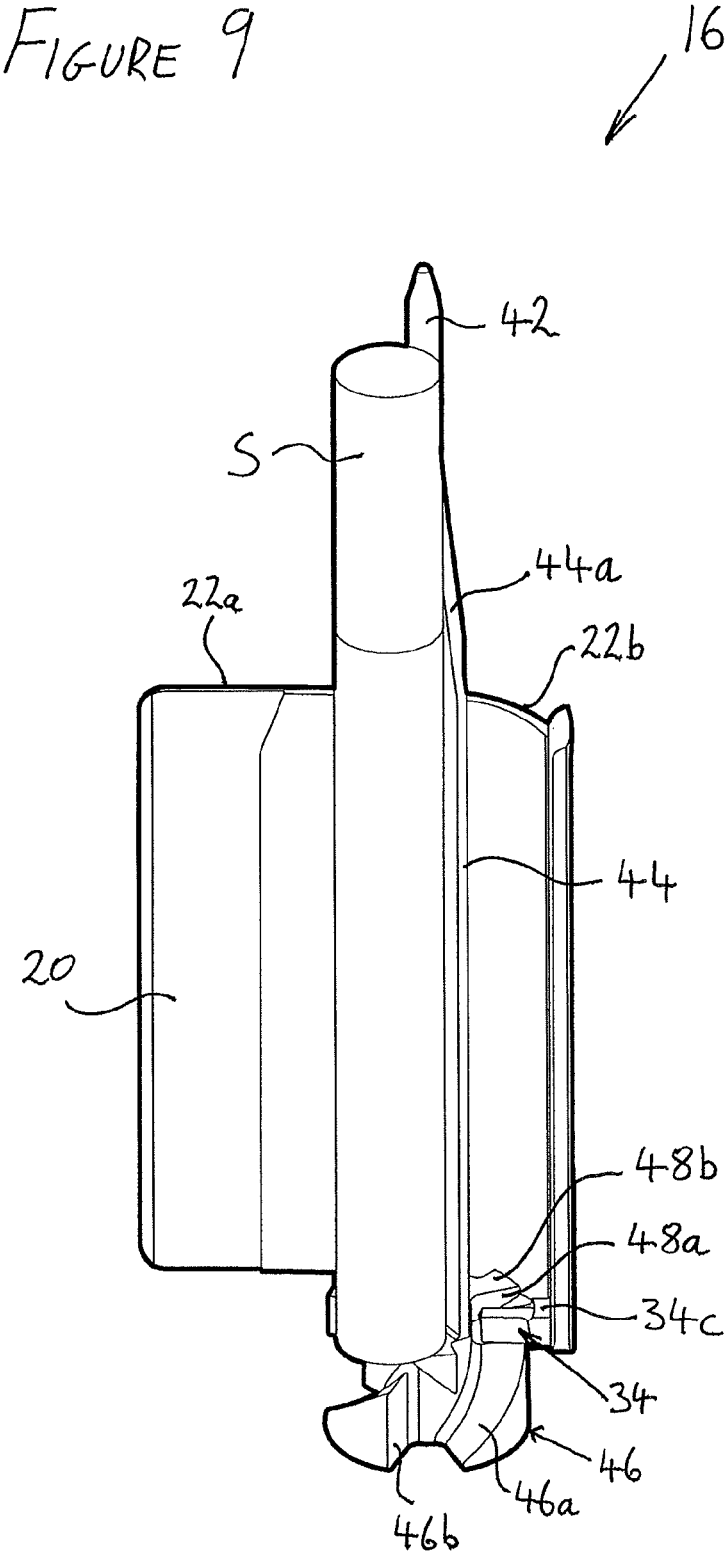
FIG. 9 is a rear perspective view corresponding to FIGS. 3 and 6 but of the slider and drive wheel of the dispenser in an intermediate position.

Once the user has removed the dispensed cigarette S, the slider 20 is the moved back downwards within the housing 12. At this point, the drive wheel 40 is in a position in which the top edge of the contact surface 46*a* of one of the helical ramps 46 is directly below the drive element 34. Downward movement of the slider 20 causes the sliding plate 22 and associated drive element 34 to move downwards until the lower engaging surface 34*a* of the drive element 34 abuts the contact surface 46*a* of the helical ramp 46, as shown in FIGS. 9 to 11 (where the position of the drive element 34 is illustrated in dashed lines in FIG. 11 as it returns from the elevated dispensing position).

Figure 10:
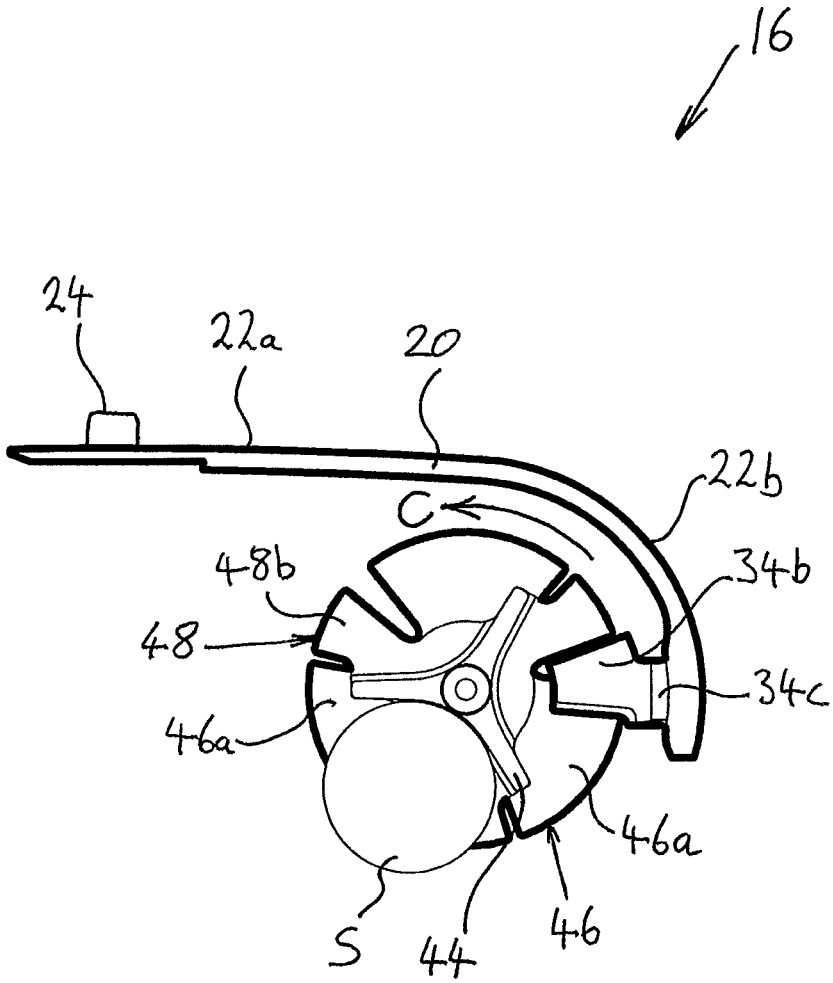
FIG. 10 is a plan view from above of the slider and drive wheel of FIG. 9.
Figure 11:
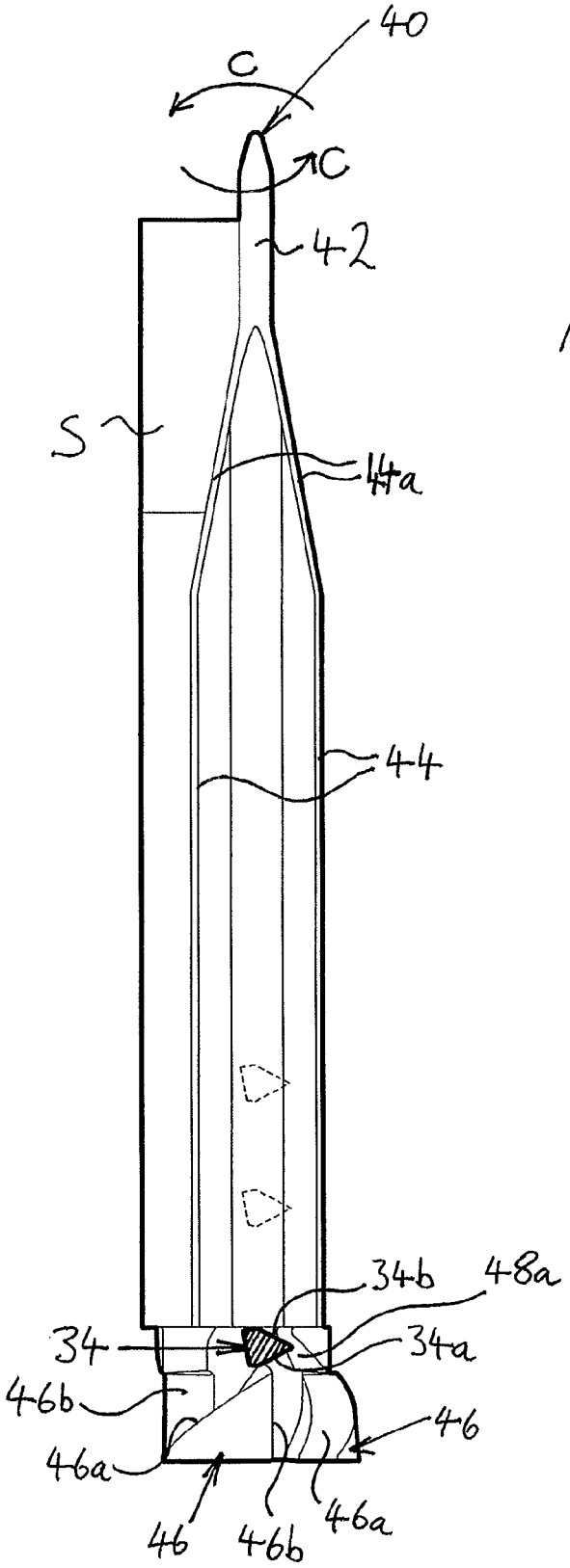
FIG. 11 is an end view of the slider (in cross section) and drive wheel shown in FIGS. 9 and 10.
Figure 12:
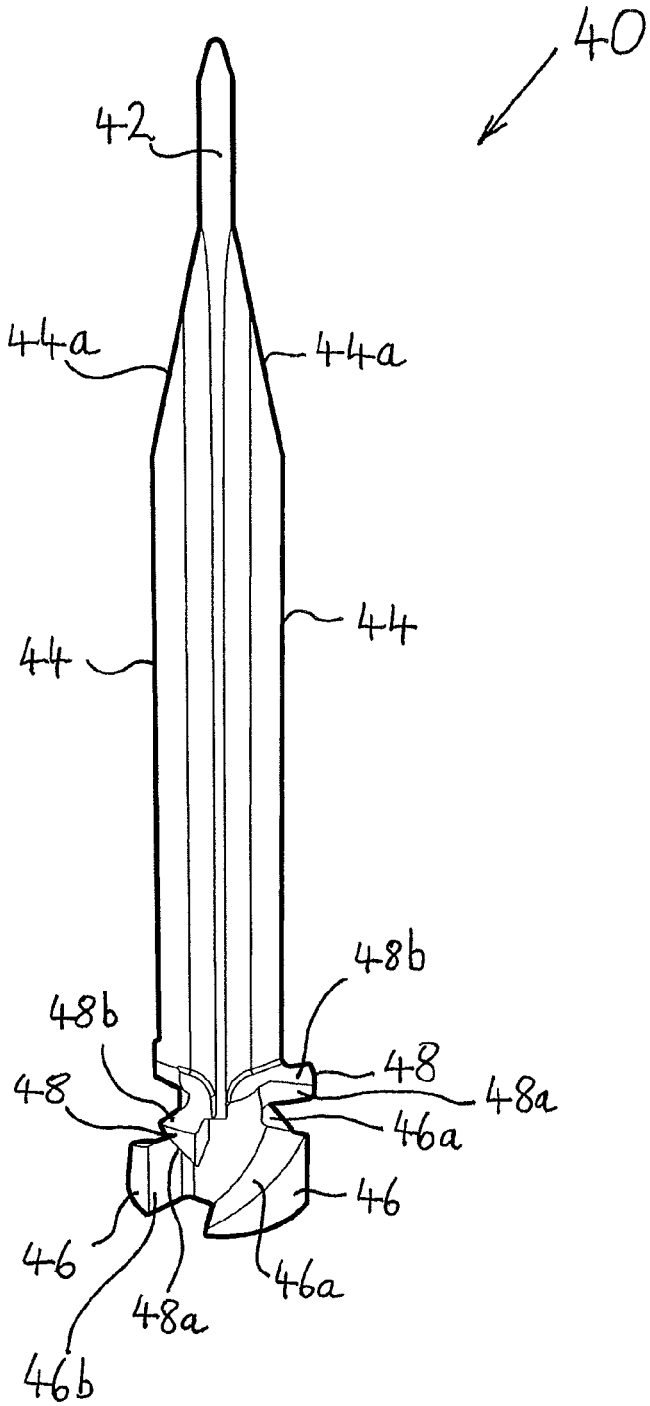
FIG. 12 is a perspective view of the drive wheel in isolation.
Figure 13:
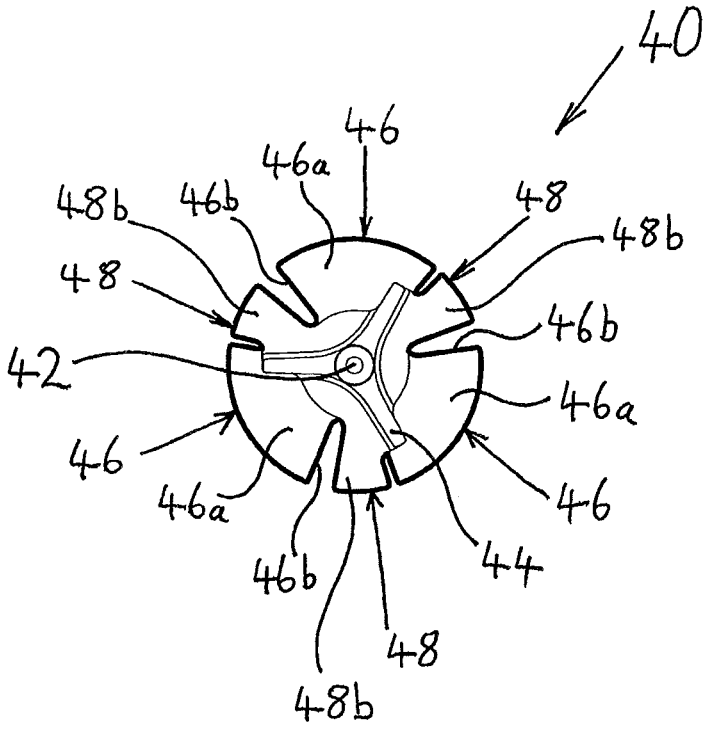
FIG. 13 is a plan view from above of the drive wheel of FIG. 12.

As the sliding plate 22 and associated drive element 34 continue to move downwards, the force of the lower engaging face 34*a* of the drive element 34 against the contact surface 46*a* of the helical ramp 46 urges the helical ramp 46 in a cam-like manner to be rotated anti-clockwise in the direction of arrow 'C', as shown in FIGS. 10 and 11. Movement of the helical ramp 46 thereby causes the whole drive wheel 40 to be rotated. In can be seen from the length of the contact surface 46*a* of the helical ramp 46 being significantly longer than the lower contact surface 48*a* of the support element 48, that this portion of rotation comprises a major movement of the drive wheel 40. The rotation of the drive wheel 40 causes the fins 44 to push against the next cigarette S to be dispensed in the belt 18 of cigarettes S, and so the entire belt 18 of cigarettes S is indexed along within the housing 12. The drive wheel 40 is rotated until the drive element 34 reaches the standby position again as shown in FIGS. 1 to 5, when the slider 20 is at the bottom limit of its travel and the lower engaging face 34*a* of the drive element 34 reaches and contacts the base 60. At this point, said next cigarette S to be dispensed has been moved into partial alignment with the dispensing aperture 14*a* and the dispenser 10 is ready to dispense another cigarette S by repeating the process described above.

Figure 28:
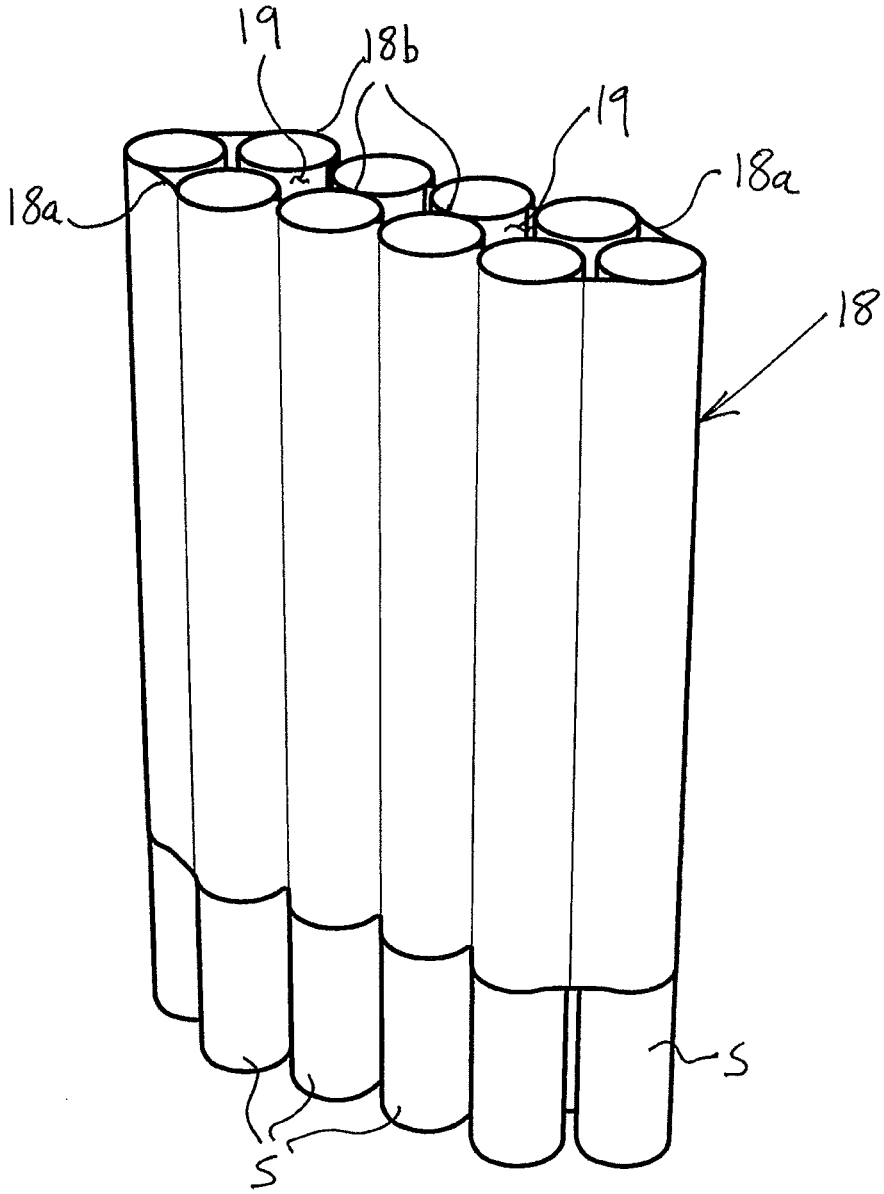
FIG. 28 is a perspective view of a belt of cigarettes of the invention for use in the dispensers of the invention.
Figure 29:
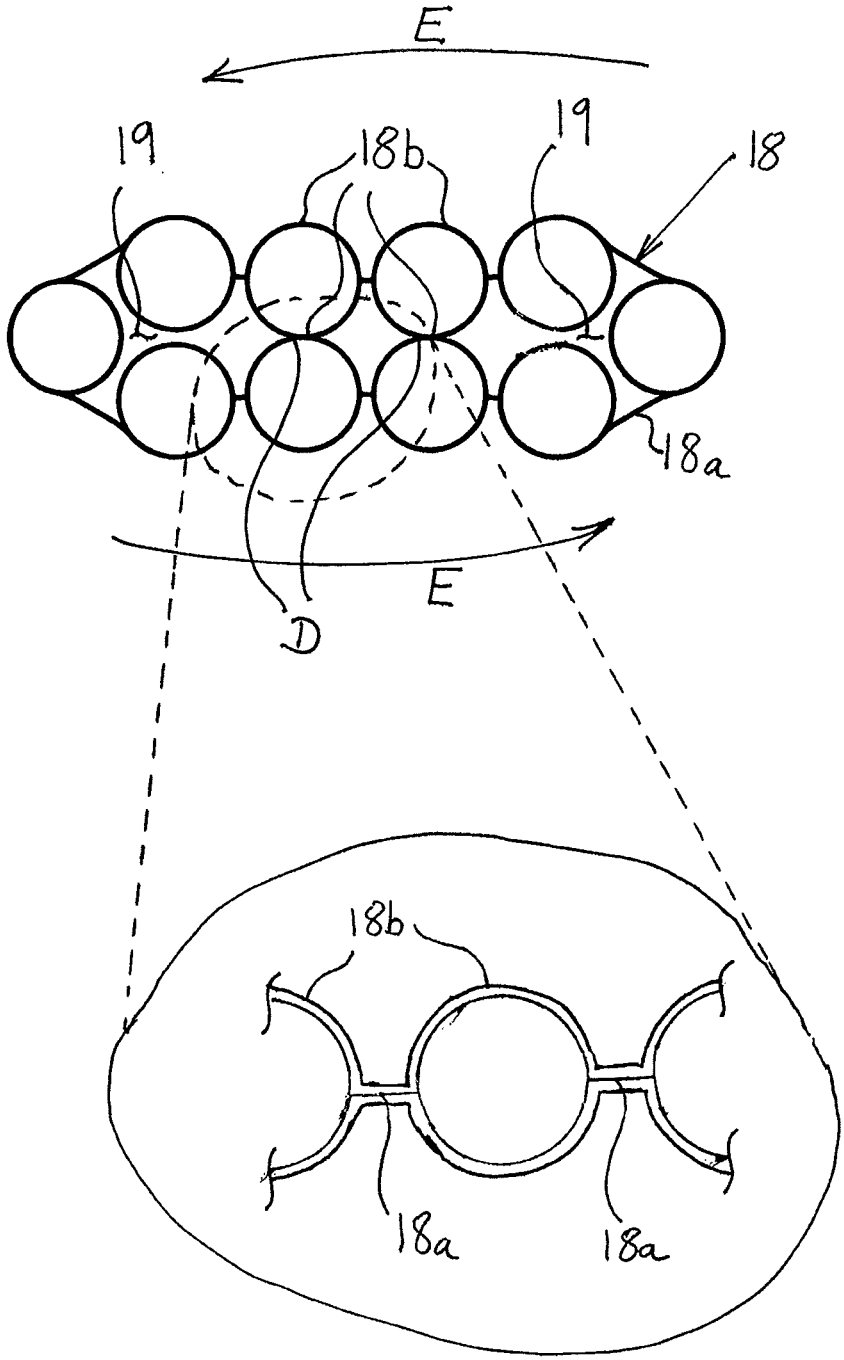
FIG. 29 is a plan view from above of the belt of cigarettes shown in FIG. 28, including an enlarged view of a portion thereof.

The belt 18 of cigarettes S is shown in more detail in FIGS. 28 and 29, and it can be seen that the belt 18 extends around a middle portion of the cigarettes S, but does not extend entirely to the bottom of the cigarettes S. This is so that the belt 18 does not interfere with the drive element 34 during the lifting process as the cigarette S is lifted out of the belt 18 and dispensed from the apparatus 10. The belt 18 comprises a two-ply construction in which sections 18*a* of the belt 18 between the cigarettes S are permanently bonded together, such that sections 18*b* of the belt 18 which include no bonding form sleeves in which the cigarettes S are held. The cigarettes S are frictionally held between the two plies of the belt 18, one within each sleeve 18*b*. It can be seen that in each sleeve 18*b*, each ply conforms around the curvature of the cigarette S which enables the fins 44 of the drive wheel 40 to engage each individual cigarette S as the belt 18 is indexed round the dispenser 10 as described above.

In order to facilitate the reloading of the dispenser 10 with a new belt 18 of cigarettes S, it is intended that the belt 18 of cigarettes S is provided as a continuous loop or 'caterpillar track' type configuration, and with at least two of the opposing sleeve portions 18*b* of the belt 18 in the middle of the loop bonded together with a non-permanent adhesive. Such a configuration is shown in FIG. 29, in which a portion of the belt 18 around two opposing pairs of cigarettes S in the middle of the 'caterpillar track' are held together by the non-permanent adhesive, shown at points D'. This results in two internal closed loops 19 being formed within the belt 18. The non-permanent adhesive allows the belt 18 to remain in the bonded configuration shown in FIG. 29 as a user loads the belt 18 into the dispenser 10 and the closed loops 19 facilitate the belt 18 being correctly positioned in the dispenser 10 as the user guides the top of the shaft 42 of the drive wheel 40 through one of the loops 19. Thereafter, the tapered tops 44*a* of the fins 44 guide the individual cigarettes S within the belt into the pockets between the fins 44 so the belt 18 is correctly positioned within the dispenser 10 ready for use.

When a user first uses the dispenser 10 to dispense the first cigarette S of a fresh belt 18, it will be appreciated from the above description that the indexing of the belt 18 will cause each portion of the belt which is bonded together by the non-permanent adhesive to be pulled in opposite directions, shown by arrows 'E' in FIG. 29. This easily breaks the non-permanent adhesive bond between the two sides of the belt 18 and allows the belt 18 to be freely incremented within the housing 12 in subsequent dispensing operations.

A second exemplary embodiment of a smoking article dispenser 110 the present invention will now be described with reference to FIGS. 16-27. The dispenser 110 comprises an outer housing 112 having a cap 114 and a dispensing mechanism 116 disposed within the housing 112. The cap 114 includes a dispensing aperture 114*a* though which cigarettes S are dispensed from the dispenser 110. As with the first embodiment described above, the dispenser 110 is configured to receive a belt 18 of cigarettes S (see FIGS. 28 and 29) and sequentially index and dispense each cigarette S from the dispenser 110 through the dispensing aperture 114*a* until all of the cigarettes S have been dispensed, after which, the cap 114 is removed, the empty belt 18 is removed and the dispenser 110 can be reloaded by a user with a new full belt 18 of cigarettes S. The dispenser 110 of the second embodiment of the invention is configured to operate with a belt 18 of cigarettes S of the same configuration as used with the first embodiment, and so a detailed description of the belt 18 of cigarettes S will not be repeated.

The housing 112 is generally cuboid in shape and so has two substantially flat large side walls 112*a*, and two substantially flat smaller end walls 112*b*.

The dispensing mechanism 116 is shown in more detail in FIGS. 17 to 27, and comprises a slider 120 and a belt drive wheel or carousel 140 (referred to hereafter as a 'drive wheel'). The slider 120 comprises a sliding plate 122 having an actuator button 124 (referred to hereafter as an 'actuator') projecting therefrom. The sliding plate 122 is slidably mounted within the housing 112 to slide against the inside of one end wall 112*b* and the actuator 124 extends though a slot 126 formed in said one end wall 112*b*. As in the first embodiment, the length of the slot 126 thereby defines the maximum range of sliding movement of the slider 120 within the housing 112.

The drive wheel 140 is rotatably mounted on a base 160. The base 160 has an upper surface which provides a platform 162 to support the cigarettes S in the belt 18 within the housing 112. The base 160 may be removable from or formed integrally with the housing 112, and the drive wheel 140 is mounted on the base 160 in close proximity to the sliding plate 122 on the one end wall 112*b* of the housing 112. The drive wheel 140 comprises a central shaft 142 having a plurality of fins 144 extending radially therefrom. The embodiment shown in FIGS. 16 to 27 has five fins, although the invention is not limited to this particular configuration. The tops of the fins 144 include a tapered portion 144*a* for reasons which are explained in more detail below. Viewed from above, it can be seen that each of the spaces between the fins 144 provides a pocket to accommodate a cigarette S of the belt 18 of cigarettes S.

The fins 144 extend along the majority of the height of the shaft 142, but terminate proximate the base of the shaft 142, approximately level with the platform 162. Below the fins 44 and the level of the bottom ends of the cigarettes S, the base portion of the shaft 142 includes a set of a plurality of spokes 134 extending radially from the shaft 142. Each of the spokes 134 includes a lower contact face 134*a*, an upper contact face 134*b*.

The sliding plate 122 of the slider 120 includes an initial drive element 148 and a secondary drive element 146 extending perpendicularly therefrom towards the inside of the housing 112. The secondary drive element 146 is provided at the base of the sliding plate 122 and the initial drive element 148 is disposed vertically above the secondary drive element 146 and is spaced therefrom. The secondary drive element 146 includes a helical ramp 146*a* on its upper side which is angled upwards with respect to an anti-clockwise direction of the shaft 142 when viewed from above. The initial drive element 148 includes a contact surface 148*a* on its lower side which is angled downwards with respect to an anti-clockwise direction of the shaft 142 when viewed from above. Furthermore, the initial drive element 148 also includes a support surface 148*b* on its upper side which is substantially horizontal.

The slider 120 and drive wheel 140 are configured such that when the bottom of the secondary drive element 146 is level with the bottom of the spokes 134, the platform 162 of the base 160 is level with the support surface 148*b* of the initial drive element 148.

Operation of the cigarette dispenser 110 of the second embodiment of the invention will now be described, with reference to FIGS. 16 to 27. Firstly, a user removes the cap 114 from the dispenser 110 and inserts a full belt 18 of cigarettes S into the housing 112. As the belt 18 of cigarettes S is loaded into the housing 112, the tops of the tapered portions 144*a* of the fins 144 help to guide each of the individual cigarettes S from the belt 18 into one of the pockets between the fins 144 as the belt advances. Once the belt 18 of cigarettes S is loaded into the housing 112, the cap 114 is replaced and the dispenser 110 is ready for use.

The apparatus 110 is shown in the standby position in FIGS. 16 to 20. Here, the slider 120 is at the bottom of its travel with the actuator 124 at the bottom of the slot 126 in the end wall 112*a* of the housing 112 and the top edge of the helical ramp 146*a* of the secondary drive element 146 disposed directly beneath the bottom edge of the lower contact face 134*a* of one of the spokes 134 on the drive wheel 140.

Figure 16:
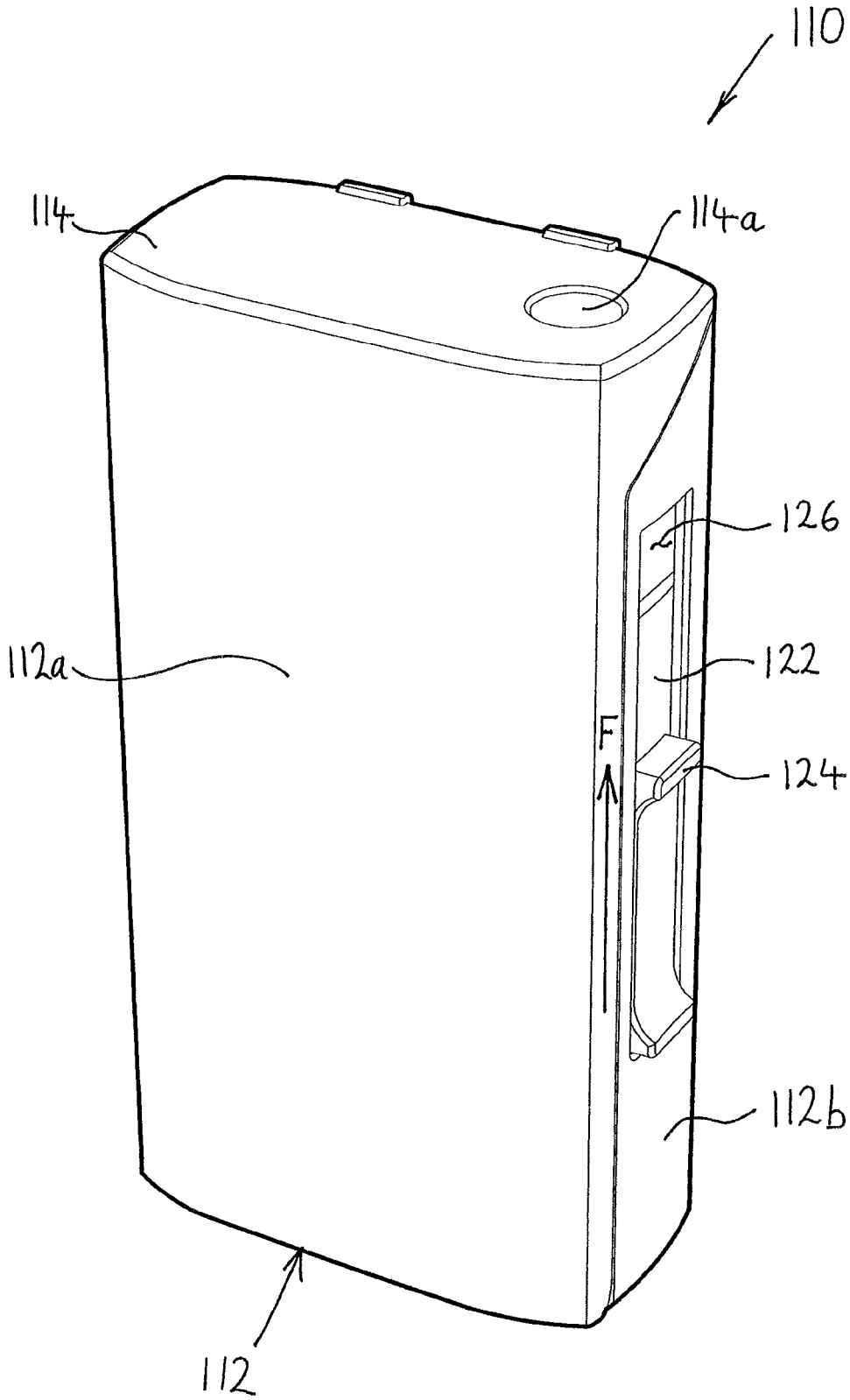
FIG. 16 shows a front perspective view of a dispenser of a second embodiment of the invention.
Figure 18:
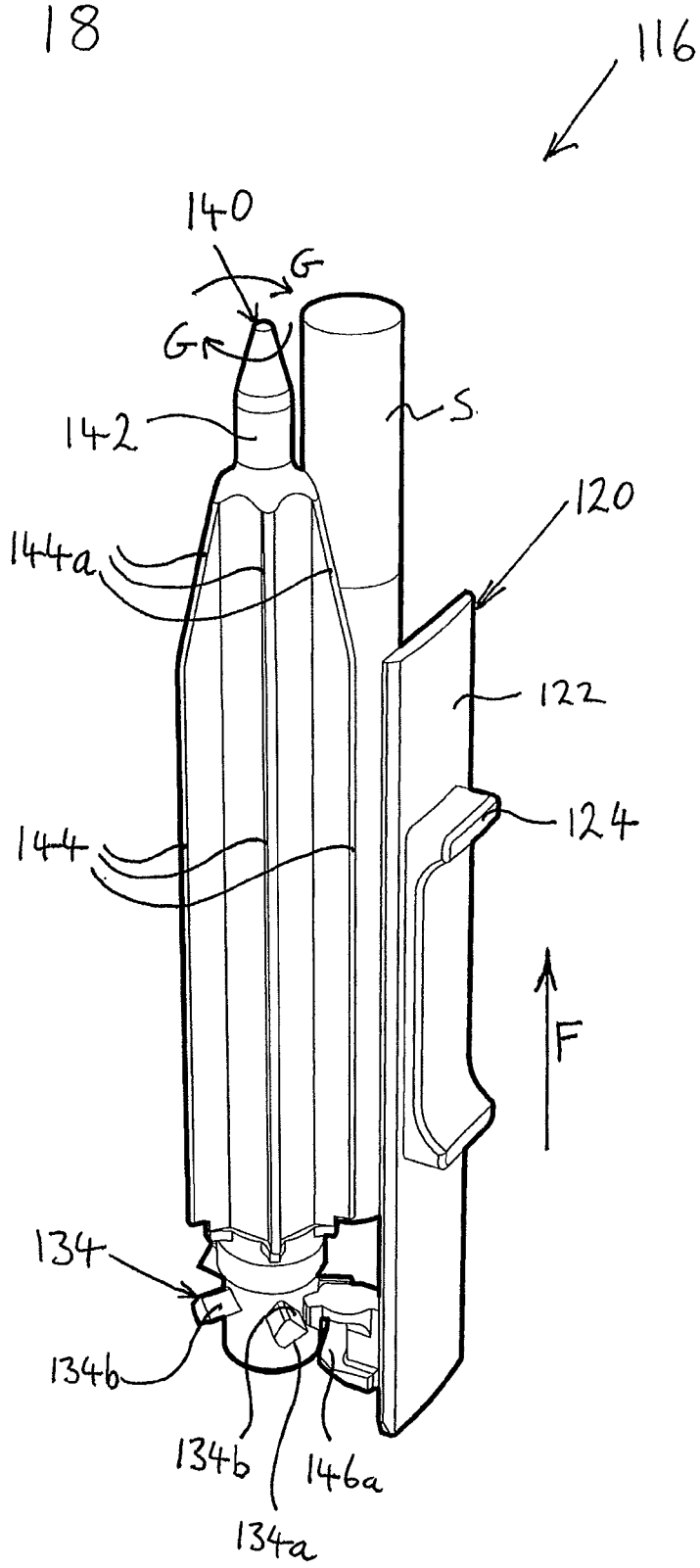
FIG. 18 is a front perspective view of the dispenser of FIGS. 16 and 17 showing only the slider and drive wheel, in a standby position.

To dispense a cigarette S from the dispenser 110, the actuator 124 is slid upwards in the direction of arrow 'F' in FIGS. 16 and 18. This causes the sliding plate 122 and associated secondary and initial drive elements 146, 148 to move upwards until the top of the helical ramp 146*a* of the secondary drive element 146 abuts against the lower contact face 134*a* of the spoke 134.

Figure 19:
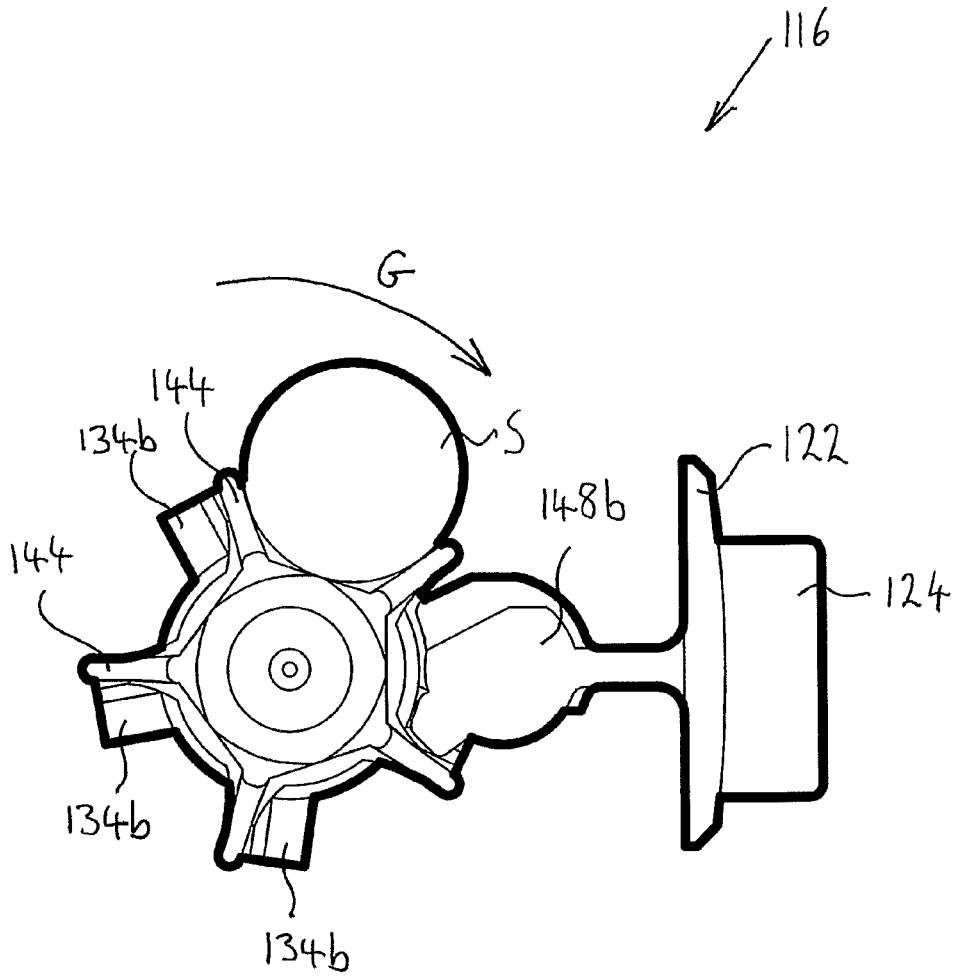
FIG. 19 is a plan view from above of the slider and drive wheel of FIG. 18.
Figure 20:
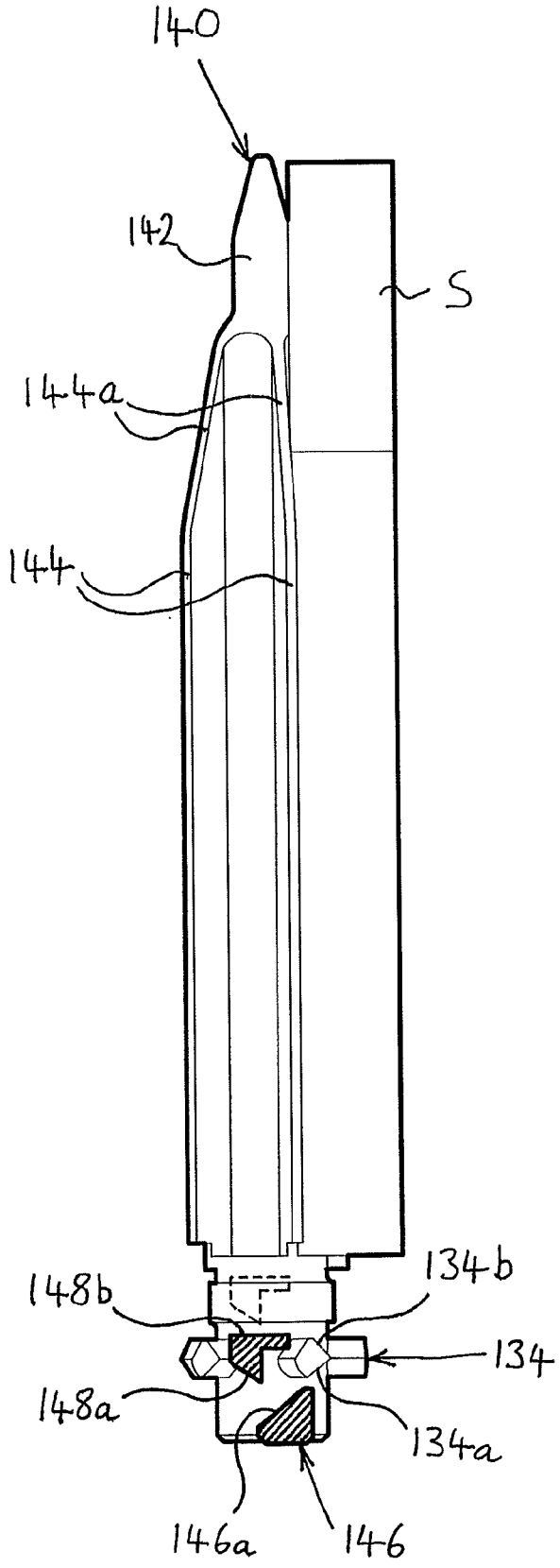
FIG. 20 is an end view of the slider (in cross section) and drive wheel shown in FIGS. 18 and 19.
Figure 21:
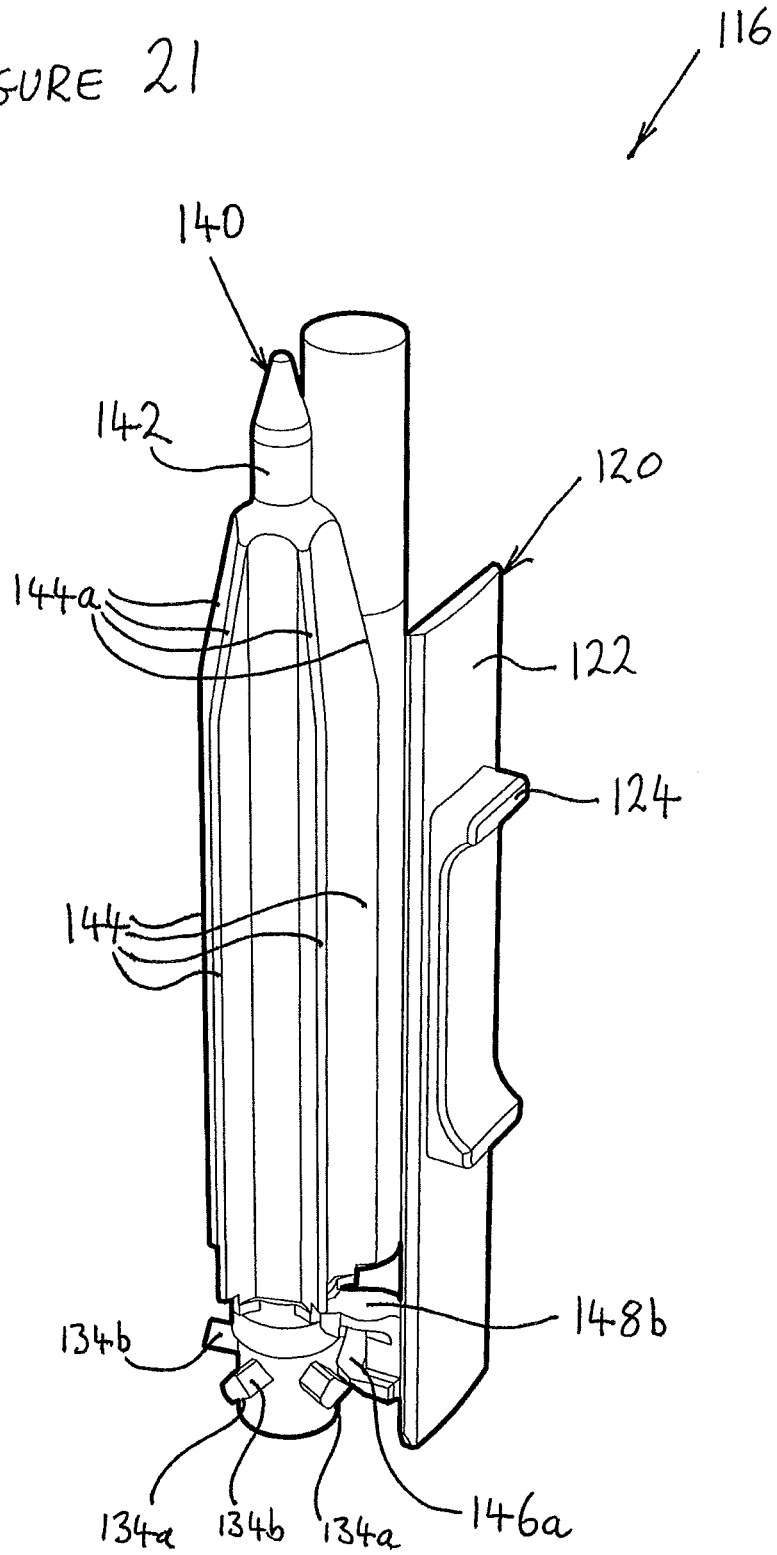
FIG. 21 is a front perspective view corresponding to FIG. 18 but of the slider and drive wheel of the dispenser in an intermediate lifting position.
Figure 22:
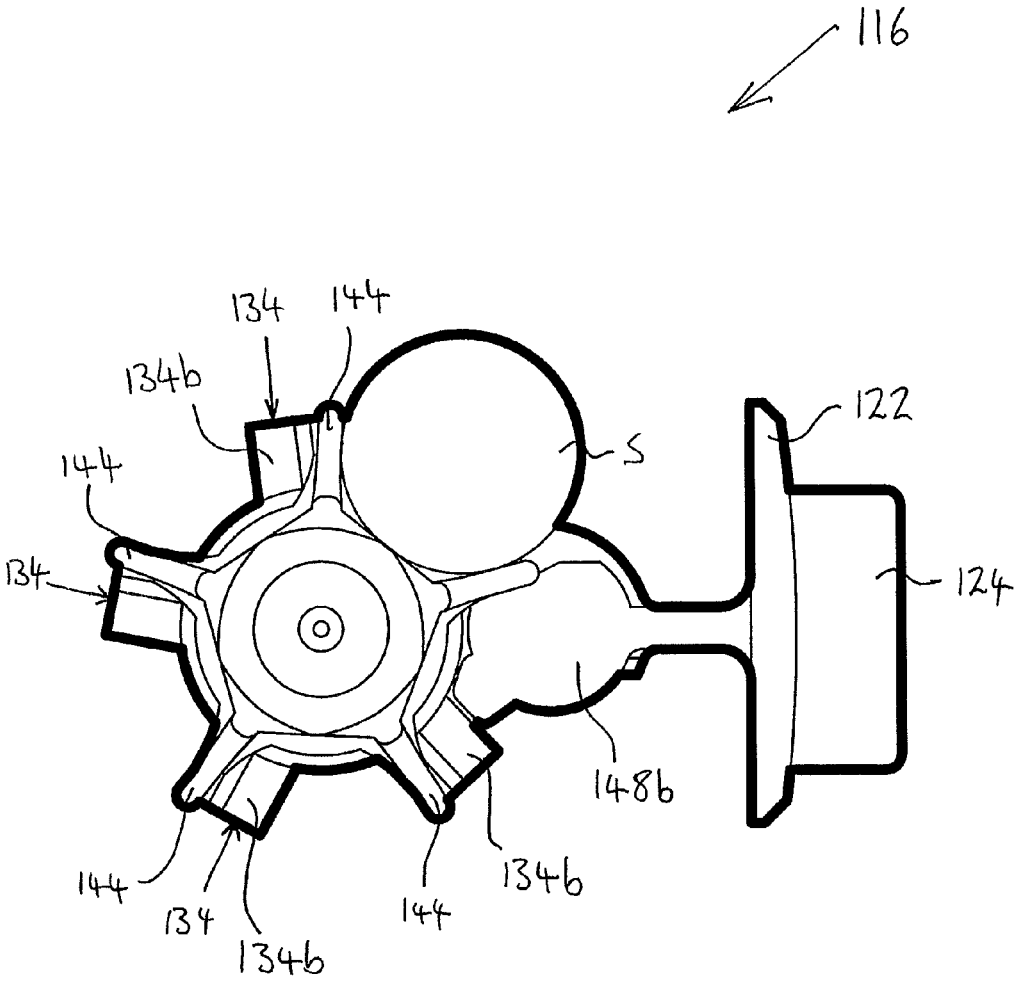
FIG. 22 is a plan view from above of the slider and drive wheel of FIG. 21.
Figure 23:
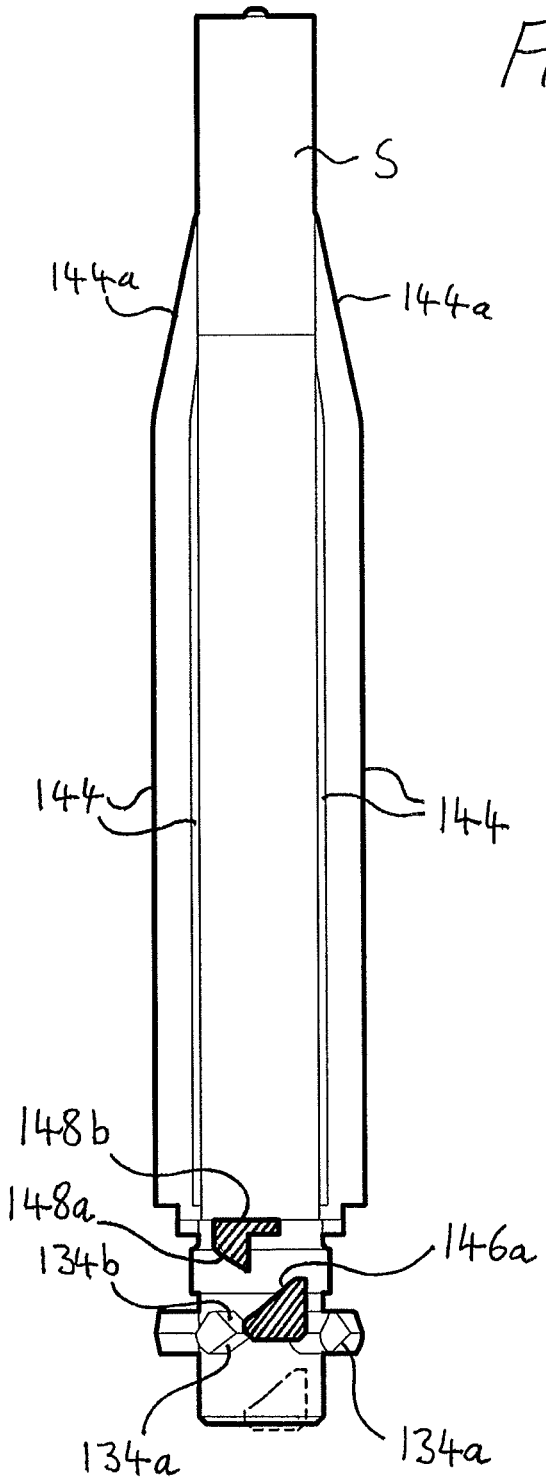
FIG. 23 is an end view of the slider (in cross section) and drive wheel shown in FIGS. 21 and 22.
Figure 24:
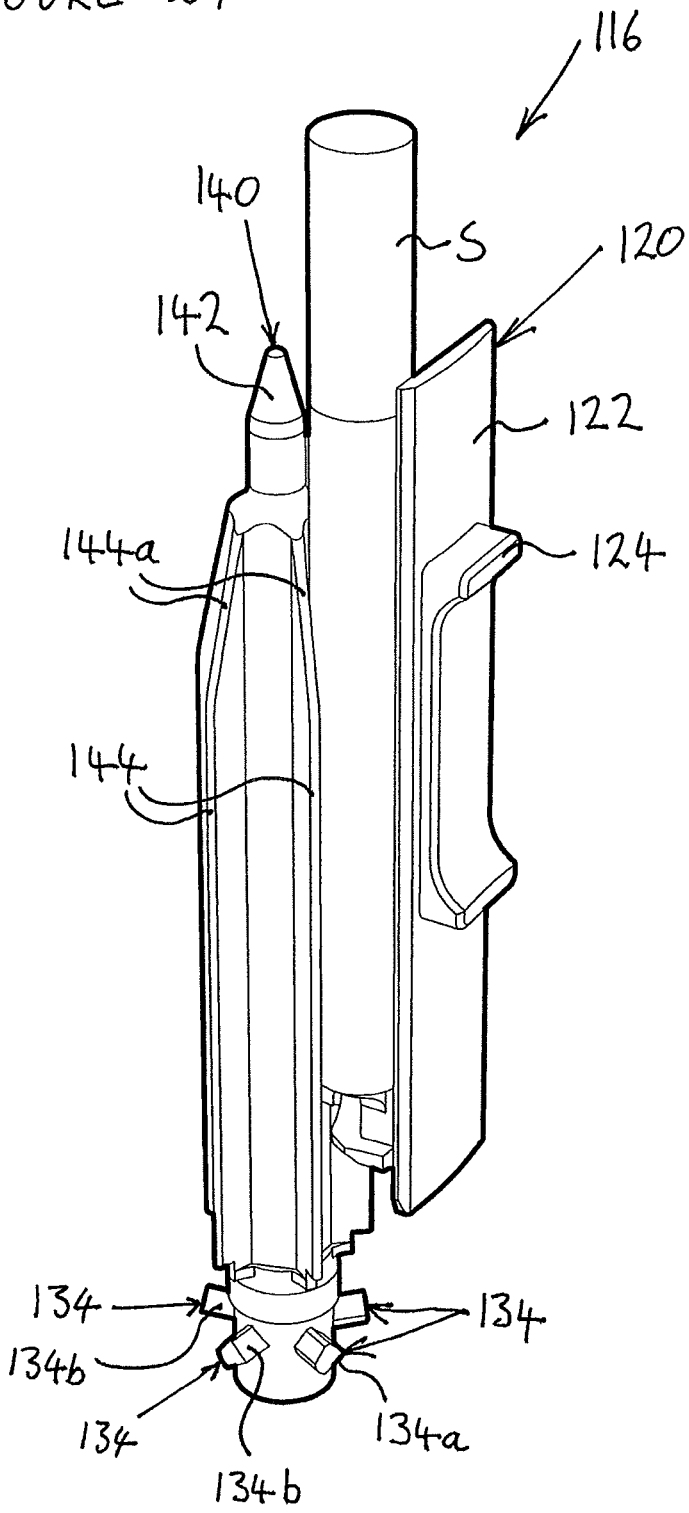
FIG. 24 is a front perspective view corresponding to FIGS. 18 and 21 but of the slider and drive wheel of the dispenser in an elevated dispensing position.
Figure 25:
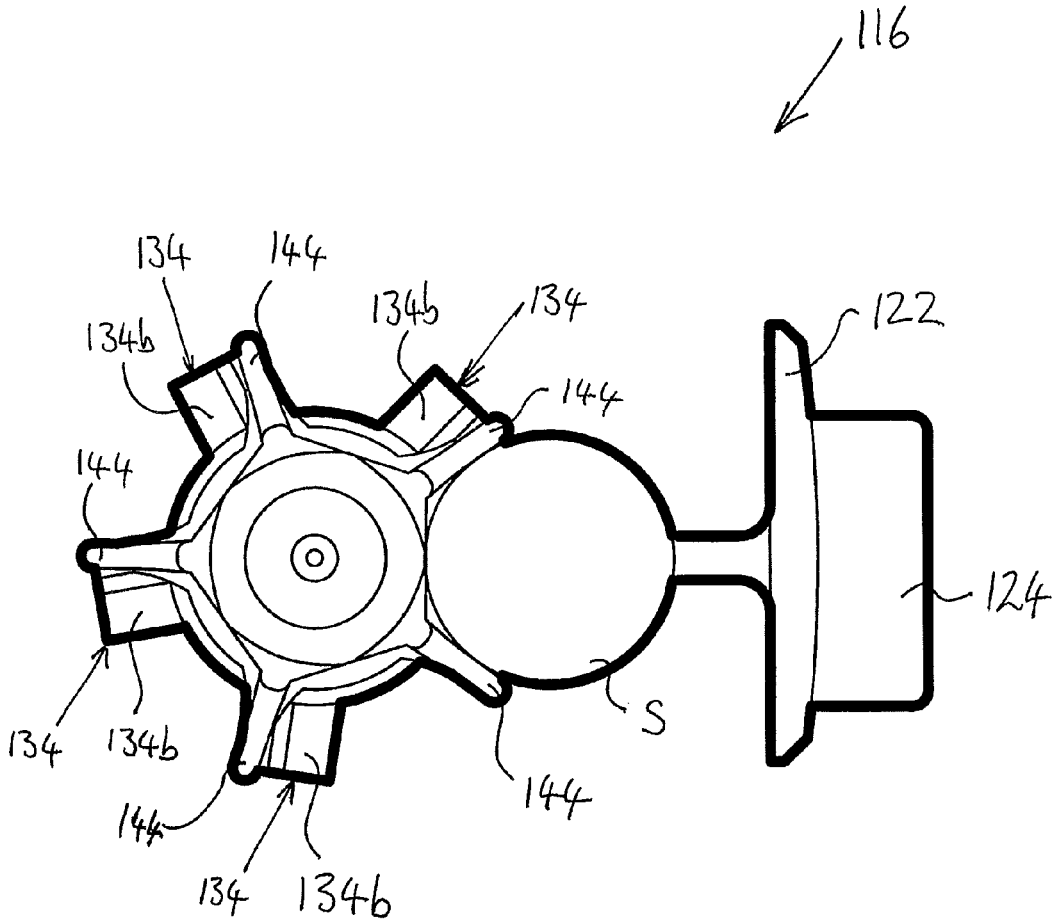
FIG. 25 is a plan view from above of the slider and drive wheel of FIG. 24.
Figure 26:
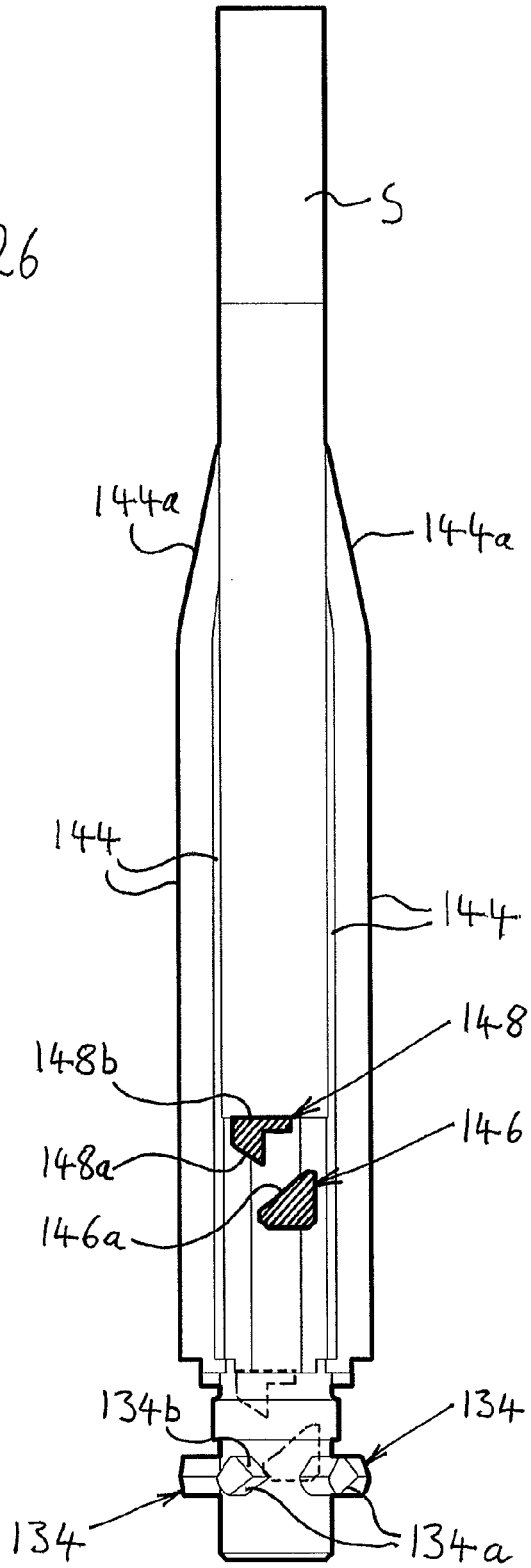
FIG. 26 is an end view of the slider (in cross section) and drive wheel shown in FIGS. 24 and 25.
Figure 27:
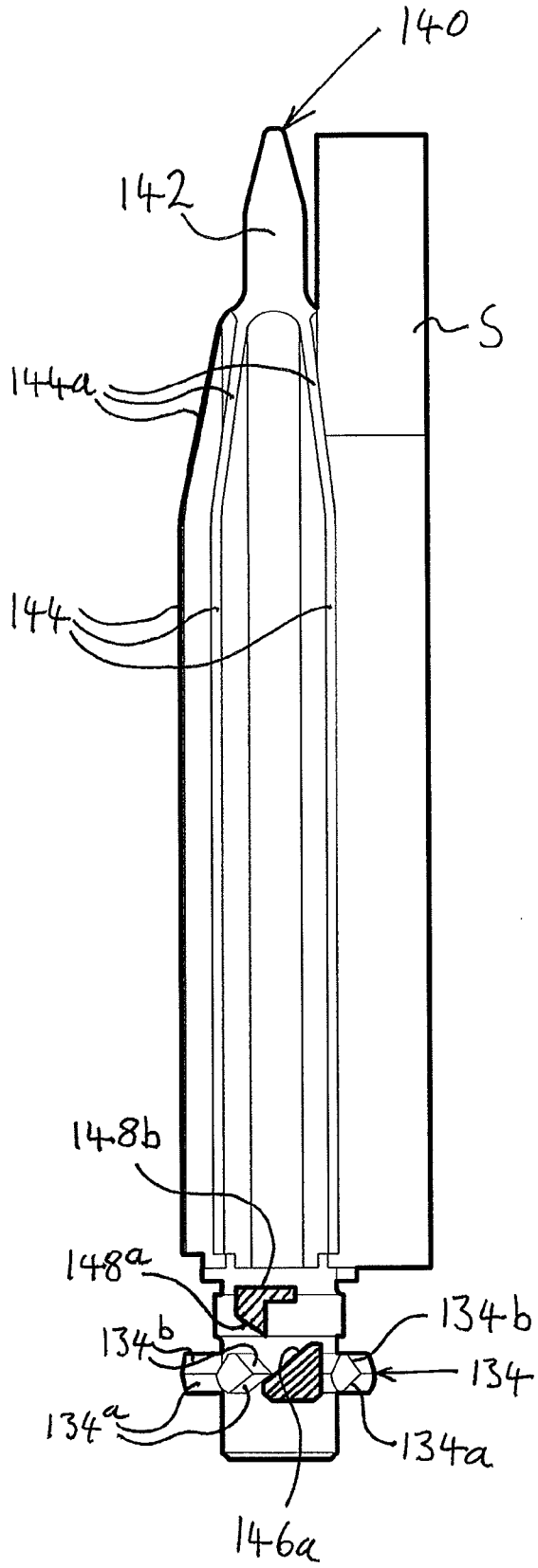
FIG. 27 is an end view corresponding to FIGS. 20, 23 and 26 but of the slider (in cross section) and drive wheel of the dispenser in an intermediate return position.

As the sliding plate 122 and associated secondary and initial drive elements 146, 148 continue to move upwards, towards the position of the initial drive element 148 shown in dashed lines in FIG. 20, the force of the helical ramp 146*a* of the secondary drive element 146 against the lower contact face 134*a* of the spoke 134 urges the spoke 134, and thereby the whole drive wheel 140, to be rotated clockwise in the direction of arrow 'G', as shown in FIGS. 18 and 19. The rotation of the drive wheel 140 causes the fins 144 to push against the adjacent cigarette S in the belt 18 of cigarettes S, and so the entire belt 18 of cigarettes S is indexed around within the housing 112. When the slider 122 has been moved upwards to the point where the spoke 134 is positioned at the bottom of the helical ramp 146*a* of the secondary drive element 146, the support surface 148*b* of the initial drive element 148 is level with the bottom ends of the cigarettes S in the belt 18, and the cigarette S being urged round by the fins 144 has been indexed into alignment with the dispensing aperture 114*a* and is seated on the support surface 148*b*. This is the intermediate lifting position shown in FIGS. 21 to 23. (Note: the aligned cigarette S to be dispensed is removed in FIGS. 21 and 22 to show the dispensing mechanism 116 more clearly, and only the subsequent cigarette S to be dispensed is shown. However, the aligned cigarette S to be dispensed is shown in FIG. 23, with the previous position of the secondary drive element 146 shown in dashed lines).

As the sliding plate 122 and associated secondary and initial drive elements 146, 148 continue to move upwards, the cigarette S is lifted upwards on the support surface 148*b* of the initial drive element 148 and protrudes through the dispensing aperture 114*a* in the cap 114 to enable the user to grip the cigarette S and remove it fully from the dispenser 110. At this point, the slider 120 is at the top of its range of movement with the actuator 124 abutting the top edge of the slot 126 in the elevated dispensing position shown in FIGS. 24 to 26, with the previous (and subsequent) position of the secondary drive element 146 shown in dashed lines. As described in connection with the first embodiment, the cigarettes S are held in loose frictional contact within the belt 18 of cigarettes S and so may be slid upwards out of the belt 18 during the above-described dispensing process, and the belt 18 also serves to guide each cigarette S directly upwards without lateral movement so that it cleanly projects through the dispensing aperture 114*a* in the cap 114.

Once the user has removed the dispensed cigarette S, the slider 120 is the moved back downwards within the housing 112. At this point, the drive wheel 140 is in a position in which the upper contact face 134*b* of one of the spokes 134 is directly below the lower contact surface 148*a* of the initial drive element 148, and the secondary drive element 146 is vertically aligned with a circumferential gap between two adjacent spokes 134 directly below it. Downward movement of the slider 120 causes the sliding plate 122 and associated secondary and initial drive elements 146, 148 to move downwards and the secondary drive element 146 passes through the circumferential gap between two adjacent spokes 134 directly below it (see FIG. 27) until the lower contact surface 148*a* of the initial drive element 148 abuts the upper contact face 134*b* of the spoke 134.

As the sliding plate 122 and associated secondary and initial drive elements 146, 148 continue to move downwards, the force of the lower contact surface 148*a* of the initial drive element 148 against the upper contact face 134*b* of the spoke 134 urges the spoke 134, and thereby the whole drive wheel 140, to be rotated clockwise. The rotation of the drive wheel 140 causes the fins 144 to push against the next cigarette S to be dispensed in the belt 18 of cigarettes S, and so the entire belt 18 of cigarettes S is indexed along within the housing 112. The drive wheel 140 continues to be rotated until the upper edge of the lower contact surface 148*a* of the initial drive element 148 reaches the lower edge of the upper contact face 134*b* of the spoke 134 and the secondary drive element 146 reaches and contacts the base 160. At this point, the dispenser 110 is back in the standby position as shown in FIGS. 16 to 20, where the slider 120 is at the bottom limit of its travel with the actuator 124 abutting the bottom edge of the slot 126, ready to dispense another cigarette S by repeating the process described above.

Figure 17:
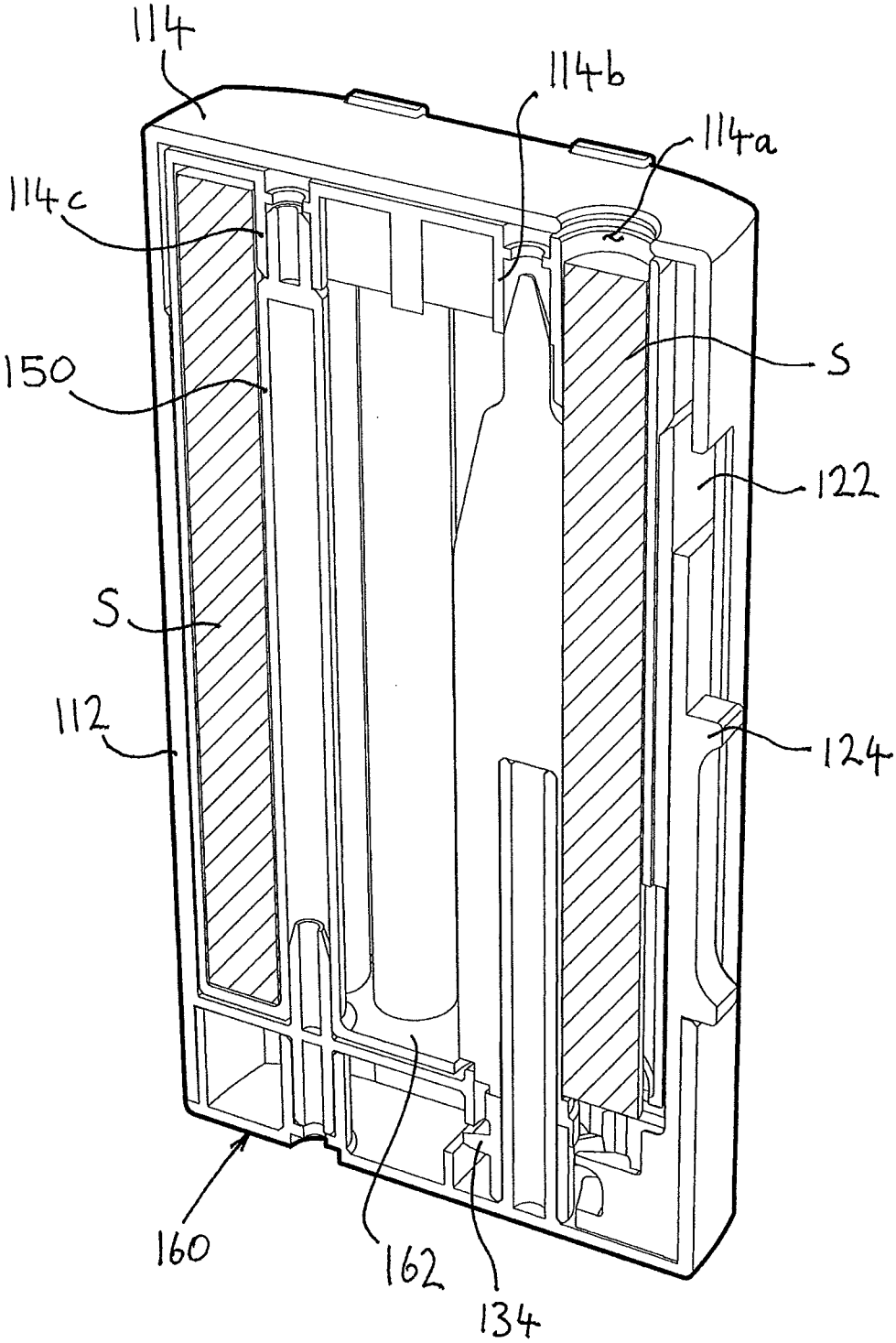
FIG. 17 shows front perspective cross-sectional view of the dispenser of FIG. 16 loaded with a charge of cigarettes.

It can be seen from FIG. 17 that the second embodiment of the invention includes a support spindle 150 extending from the base 160 parallel to the drive wheel 140. This assists in guiding the belt 18 within the housing 112 during loading and operation of the dispenser 110. This is an optional feature of the second embodiment, and such a secondary spindle could also be included with the dispenser 10 of the first embodiment of the invention described above, within the scope of the invention.

The cap member 114 includes first and second recesses 114*b*, 114*c* to receive and locate the uppermost tips of the shaft 142 of the drive wheel 140 and the spindle 150 respectively, when the cap 114 is fitted to the housing 112. The cap 114 thereby rotatably secures the drive wheel 140 and spindle 150 in place within the dispenser 110.

It is advantageous that the cigarettes S are held with sufficient friction within the sleeves 18*b* of the belt 18 so that they can pass over a space in the dispenser 10/110 and remain held within the belt without slipping downwards under their own weight through the sleeve 18*b*. This helps make the indexing and conveying process described above and avoids the possibility of the cigarettes fouling the dispensing mechanism, although it will be appreciated from the description above, that the dispenser 10/110 is configured to avoid such problems in any case.

Although the two embodiments described above comprise drive wheels 40/140 with 3 and 5 fins 44/144 (and thereby 3 and 5 pockets defined between the fins 44/144) respectively, it will be appreciated that different numbers of spokes/pockets may be provided within the scope of the invention.

The shape of the dispenser may vary within the scope of the invention, and may include round, oval, triangular, and other shaped housings within which a continuous belt of cigarettes may be indexed and dispensed as described above.

Although the first exemplary dispenser 10 included an actuator on the large side face 12*a* of the housing 12, and the second exemplary dispenser 110 included an actuator on the small end face 112*b* of the housing 112, the invention is not limited to the actuator location which can vary within the scope of the invention.

Although the drive wheels 40/140 are described as shafts 42/142 with fins 44/144 extending therefrom, the invention is not limited to such a configuration, and other configurations are intended within the scope of the invention, such as a drum having a plurality of recesses or channels formed therein.

Although the configuration of belt 18 shown and described includes 10 cigarettes S, the belt 18 could include more or less cigarettes S within the scope of the invention. Any suitable material may be used for the belt 18, such as paper, card or plastics, within the scope of the invention. Furthermore, although the exemplary embodiments shown and described include a belt in which cigarettes are held in sleeves in the belt, it is envisaged that alternative configurations of belt may be included within the scope of the invention and operable with the dispenser, such as a continuous belt in which the smoking articles are adheres to an outer surface of the belt by, for example, weak non-permanent adhesive.

The exemplary embodiments are described as being operable with a 'belt' of smoking articles, although it will be appreciated that a pre-loaded charge of smoking articles for use in a dispenser of the invention may not necessarily be provided in a 'belt' configuration, and may alternatively be provided in a cartridge system or, more generally, any other suitable contained configuration of unit of a plurality of smoking articles loadable into and operable with the dispenser.

Both of the exemplary embodiments of the dispenser of the invention described above include a dispensing mechanism in which rotation of a drive wheel is actuated in both upwards and downwards directions of movement of a slider. However, it will be appreciated from the following claims that the invention is not limited to such operational movement and is intended to at least also include embodiments in which rotational movement of a drive wheel is actuated by only movement of a sliding actuator in a single direction.

The exemplary embodiments are described as being reloadable dispensers, although the configuration could also be applied to a disposable smoking article dispenser, within the scope of the invention.

The cap 14/114 in both embodiments described above is described as being removable, although it may equally take other configurations, such as pivotably openable from the housing 12/112 to allow access to the interior of the housing 12/112.

The drive element 34 of the dispenser 10 of the first embodiment of the invention is described as having a separate upper engaging face 34*b* and a lifting face 34*c*. However, it is intended that the lifting face could be omitted or, be integral with the upper engaging face 34*b* or, they could be one and the same, such that an upper area of the drive element 34 generally lifts the cigarette S.

Although two exemplary embodiments of the invention have been described above, it will be appreciated that various modifications may be made to these embodiments within the scope of the invention which is defined by the claims hereafter. Any combinations of non-mutually exclusive features described above are intended to fall within the scope of the invention.

The invention claimed is:

1. A dispenser comprising: a housing, the housing defining a chamber to receive a charge of smoking articles coupled by a continuous belt wherein the longitudinal axis of each smoking article extends between first and second ends of the housing, and a mechanism to advance the belt in a lateral direction to move a smoking article of the belt into alignment with an aperture in said first end of the housing, said mechanism including a belt drive wheel rotatably mounted to the second end of the housing and extending upwardly within the chamber towards said first end, the belt drive wheel including a plurality of radially extending elements to engage smoking articles held in the belt to advance the belt, the mechanism also being operable to push the aligned smoking article from the belt and eject it in a longitudinal direction from the housing through said aperture.

2. The dispenser according to claim 1, wherein the mechanism includes a slider received in the chamber to contact the end of an aligned smoking article closest to the second end of the housing to lift said smoking article in a longitudinal direction out of the housing through the aperture.

3. The dispenser according to claim 2, wherein the slider includes an actuator that extends through the housing to enable a user to raise the slider in a direction towards said first end of the housing and thereby lift said smoking article in a longitudinal direction out of the housing through the aperture in the first end.

4. The dispenser according to claim 3, wherein the drive wheel comprises a plurality of longitudinally extending pockets between the radially extending elements, wherein a smoking article is drawn into a pocket as the drive wheel rotates to advance the belt.

5. The dispenser according to claim 4, wherein a smoking article contained in a pocket is moved into alignment with the aperture when the belt drive wheel rotates.

6. The dispenser according to claim 3, wherein the slider and belt drive wheel include cooperating members that cooperate to rotate the drive wheel to advance the belt and move a smoking article into partial alignment with the aperture in the first end of the housing in response to movement of the slider by a user.

7. The dispenser according to claim 6, wherein a smoking article contained in a pocket of the belt drive wheel is moved into partial alignment with the aperture in the first end of the housing in response to lowering of the slider in a direction towards the second end of the housing following movement of the slider in a direction towards the first end of the housing to eject a previous smoking article.

8. The dispenser according to claim 7, wherein the belt drive wheel and the housing is configured such that the belt drive wheel has a portion that extends below a charge of smoking articles received in the chamber at the second end of the housing, the cooperating member on the belt drive wheel being formed on said portion of the belt drive wheel below a charge of smoking articles received in the chamber.

9. The dispenser according to claim 8, wherein the cooperating member on the belt drive wheel comprises an upwardly facing helical ramp associated with each pocket.

10. The dispenser according to claim 9, wherein the cooperating member on the slider comprises a drive element having a lower engaging face that contacts an upper end of the helical ramp associated with the pocket from which a smoking article has been ejected, when the slider is lowered following movement of the slider in an upward direction to eject said smoking article, wherein the belt drive wheel rotates as the drive element slides down the helical ramp to advance the belt and move the next smoking article into partial alignment with the aperture in the first end of the housing.

11. The dispenser according to claim 10, wherein the belt drive wheel comprises a smoking article end support member associated with each pocket that supports the end of a smoking article received in a pocket to prevent it from sliding down the belt drive wheel in a direction towards said helical ramp.

12. The dispenser according to claim 11, wherein a smoking article end support member is located above the lower end of each helical ramp and each helical ramp is located beneath said smoking article end support member associated with the next pocket when the drive element has reached the lower end of the helical ramp associated with one pocket.

13. The dispenser according to claim 12, wherein the smoking article end support member has a lower contact surface and the drive element has an upper engaging face, at least one of said lower contact surface and upper engaging face being angled so when the slider is raised to eject a smoking article from a pocket, the upper engaging face of the drive element initially contacts said lower contact surface of the support member located above it, thereby causing the belt drive wheel to rotate as the lower contact surface and upper engaging face slide relative to each other to move a partially aligned smoking article into full alignment with the aperture.

14. The dispenser according to claim 13, wherein the upper engaging face of the drive element contacts the end of a fully aligned smoking article supported by said smoking article end support member after clearing said lower contact surface of the support member, further movement of the slider causing said drive element to lift said fully aligned smoking article in a longitudinal direction out of the housing through the aperture.

15. The dispenser according to claim 8, wherein the cooperating member on the belt drive wheel comprises a radially extending spoke associated with each pocket, each spoke having upper and lower contact faces.

16. The dispenser according to claim 15, wherein the cooperating member on the slider comprises an initial drive element having a lower contact surface to contact the upper contact face of a spoke associated with a pocket as the slider is lowered following ejection of a smoking article from said pocket, at least one of said lower contact surface and upper contact face being angled such that the drive wheel rotates as the spoke slides across the initial drive element to move a leading smoking article into partial alignment with the aperture.

17. The dispenser according to claim 16, wherein the cooperating member on the slider further comprises a secondary drive element defining an upwardly facing helical ramp positioned below the initial drive element and when the slider is lowered, the secondary drive element passes between adjacent spokes extending from the drive wheel prior to cooperation between the initial drive element and a spoke to cause initial rotation of the drive wheel.

18. The dispenser according to claim 17, wherein the initial drive element and spokes follow initial rotation of the drive wheel as a result of cooperation between the drive element and a spoke, a spoke associated with the next pocket is located above the helical ramp of the secondary drive element and when the slider is raised to eject a smoking article associated with said next pocket, the helical ramp contacts the lower contact face of said spoke and the drive wheel rotates further as the spoke slides across said ramped helical surface of the secondary drive element to move a smoking article fully into alignment with said aperture, said secondary drive element passing between adjacent spokes following said rotation and after a spoke has cleared said ramped helical surface.

19. The dispenser according to claim 16, wherein the initial drive element has an upper surface to contact the second end of a smoking article and lift it out of a pocket through said aperture when the slider is raised.

20. The dispenser according to claim 1, wherein the first end of the housing comprises a cap to close the chamber and enable access to the chamber to allow the charge of smoking articles to be inserted therein, said aperture being formed in the cap.

21. A belt to receive a charge of smoking articles comprising an endless belt of first and second material layers permanently connected to each other at spaced locations along the length of the belt to define a series of sleeves each sleeve extending in a direction across the width of the belt, each sleeve configured to receive a single smoking article wherein the belt is folded following insertion of a charge of smoking articles to form at least one of a bundle and a cartridge of smoking articles, and wherein adjacent material layers of the bundle are releasably joined at discrete locations to retain the smoking articles in bundled form.

22. The belt according to claim 21, wherein the bundle is formed with an aperture therethrough to receive a drive element of a smoking article dispenser.

23. The dispenser according to claim 1, wherein the dispenser receives the belt containing a charge of smoking articles, the belt comprising an endless belt of first and second material layers permanently connected to each other at spaced locations along the length of the belt to define a series of sleeves, each sleeve extending in a direction across the width of the belt, each sleeve able to receive a single smoking article, wherein the belt is folded following insertion of the charge of smoking articles to form at least one of a bundle and a cartridge of smoking articles, and wherein adjacent material layers of the bundle are releasably joined at discrete locations to retain the smoking articles in bundled form.

24. A method of filling a dispenser with a belt of smoking articles, the dispenser comprising a housing defining a chamber to receive a charge of smoking articles coupled by a continuous belt, wherein the longitudinal axis of each smoking article extends between first and second ends of the housing, and a mechanism to advance the belt in a lateral direction to move a smoking article off the belt into alignment with an aperture in said first end of the housing, said mechanism including a belt drive wheel rotatably mounted to the second end of the housing and extending upwardly within the chamber towards said first end, the belt drive wheel including a plurality of radially extending elements to engage smoking articles held in the belt to advance the belt, the mechanism also being operable to push the aligned smoking article from the belt and eject it in a longitudinal direction from the housing through said aperture, the belt comprising an endless belt of first and second material layers permanently connected to each other at spaced locations along the length of the belt to define a series of sleeves each sleeve extending in a direction across the width of the belt, each sleeve able to receive a single smoking article wherein the belt is folded following insertion of the charge of smoking articles to form at least one of a bundle and a cartridge of smoking articles, and wherein adjacent material layers of the bundle are releasably joined at discrete locations to retain the smoking articles in bundled form, comprising opening the housing and inserting a bundle of cigarettes into the chamber.

25. The method according to claim 24, further comprising inserting the bundle such that the drive wheel of the dispenser extends through an aperture in said bundle and closing said housing.

26. The method according to claim 24 further comprising actuating an actuator to initially break a releasable join between adjacent material layers of the bundle.

27. A method of using a dispenser, the dispenser comprising a housing defining a chamber to receive a charge of smoking articles coupled by a continuous belt and wherein the longitudinal axis of each smoking article extends between first and second ends of the housing, and a mechanism to advance the belt in a lateral direction to move a smoking article off the belt into alignment with an aperture in said first end of the housing, said mechanism including a belt drive wheel rotatably mounted to the second end of the housing and extending upwardly within the chamber towards said first end, the belt drive wheel including a plurality of radially extending elements to engage smoking articles held in the belt to advance the belt, the mechanism also being operable to push the aligned smoking article from the belt and eject it in a longitudinal direction from the housing through said aperture, comprising sliding an actuator in a direction towards the top end of the housing to initially rotate the drive wheel so at least one of the plurality of radially extending elements on the drive wheel engages a smoking article to move a leading smoking article into alignment with an aperture in said top end and to push said leading smoking article out of said housing through said aperture.

28. The method according to claim 27, further comprising sliding the actuator in a direction towards the lower end of the housing to further rotate the drive wheel in the same direction and move the next leading smoking article into partial alignment with the aperture in the housing.

29. A smoking article dispenser comprising:

a dispenser housing to receive a smoking article cartridge;

a smoking article dispensing aperture formed in the surface of the dispenser housing;

a cartridge advancement mechanism that comprises a plurality of surface-engagable elements to facilitate advancing cartridge position and dispensing smoking articles from the smoking article cartridge when a user-operable element is actuated;

wherein the plurality of surface-engagable elements are configured to urge a drive wheel that advances smoking articles from the smoking article cartridge within the dispenser housing into alignment for dispensing.

30. The smoking article dispenser of claim 29 wherein the smoking articles are seated on a support tab that ejects the smoking articles after the smoking articles are fully aligned.

31. The smoking article dispenser of claim 29, wherein the smoking article cartridge is a belt of smoking articles.

32. The smoking article dispenser of claim 29, wherein the user-operable element is slidable between a first position and a second position.

33. The smoking article dispenser of claim 29, wherein:

the user-operable element interacts with the surface-engagable elements to shift a smoking article from a standby position, wherein the smoking article is partially aligned with a dispensing aperture in the first position, to a dispensing position, wherein the smoking article is fully aligned with the dispensing aperture.

* * * * *

UNITED STATES PATENT AND TRADEMARK OFFICE

CERTIFICATE OF CORRECTION

PATENT NO. : 8,528,780 B2
APPLICATION NO. : 13/146920
DATED : September 10, 2013
INVENTOR(S) : Houghton et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 204 days.

Signed and Sealed this
Eighteenth Day of November, 2014

Michelle K. Lee

Michelle K. Lee
*Deputy Director of the United States Patent and Trademark Office*